US007523879B2

(12) United States Patent
Umeda et al.

(10) Patent No.: US 7,523,879 B2
(45) Date of Patent: Apr. 28, 2009

(54) CRUSHING APPARATUS

(75) Inventors: Hiroyuki Umeda, Hirakata (JP); Gosuke Nakashima, Hirakata (JP); Noriyuki Yoshida, Hirakata (JP)

(73) Assignee: Komatsu Ltd., Tokyo (JP)

( * ) Notice: Subject to any disclaimer, the term of this patent is extended or adjusted under 35 U.S.C. 154(b) by 264 days.

(21) Appl. No.: 10/577,864

(22) PCT Filed: Oct. 29, 2004

(86) PCT No.: PCT/JP2004/016102

§ 371 (c)(1),
(2), (4) Date: Apr. 28, 2006

(87) PCT Pub. No.: WO2005/039777

PCT Pub. Date: May 6, 2005

(65) Prior Publication Data

US 2007/0131807 A1 Jun. 14, 2007

(30) Foreign Application Priority Data

Oct. 29, 2003 (JP) ..... 2003-369579

(51) Int. Cl.
*B02C 25/00* (2006.01)

(52) U.S. Cl. ..... 241/34; 241/101.761; 241/186.4

(58) Field of Classification Search ..... 241/30, 241/34, 35, 36, 101.761, 186.4
See application file for complete search history.

(56) References Cited

U.S. PATENT DOCUMENTS 5,803,376 A 9/1998 Koyanagi et al.
6,474,577 B2 11/2002 Ikegami et al.

FOREIGN PATENT DOCUMENTS

| | | | |
|---|---|---|---|
| JP | 1-78701 | U | 5/1989 |
| JP | 08-024704 | A | 1/1996 |
| JP | 09-070547 | A | 3/1997 |
| JP | 3298829 | A | 4/2002 |
| JP | 2002-346407 | A | 12/2002 |

OTHER PUBLICATIONS

International Preliminary Report on Patentability, Chapter I of the Patent Cooperation Treaty, and Written Opinion of the International Searching Authority, for PCT/JP2004/016102, 5 sheets.

*Primary Examiner*—Mark Rosenbaum
(74) *Attorney, Agent, or Firm*—Frishauf, Holtz, Goodman & Chick, P.C.

(57) ABSTRACT

A rotary crushing apparatus having a hydraulic motor for driving a crusher includes a load detector for detecting a loading state of the hydraulic motor, a load judging device for judging the loading state of the hydraulic motor, a feeding amount controller that stops a feeding of an object to be crushed by a feeder when the load judging device judges as overloaded or that starts the feeding of the object to be crushed by the feeder when the load judging device judges as underloaded, and a motor capacity controller that changes a capacity of a capacity-variable motor to a large capacity when the load judging device judges as overloaded. Since the capacity of the hydraulic motor is switched to the large capacity when the feeder is stopped, it is possible to crush wood in the crusher with high torque and to reduce the load in order to recover to a former state in a short time.

8 Claims, 16 Drawing Sheets

CRUSHING APPARATUS

This application is a U.S. National Phase Application under 35 USC 371 of International Application PCT/JP2004/016102 filed Oct. 29, 2004.

TECHNICAL FIELD

The present invention relates to a crushing apparatus for crushing an object to be crushed such as wood and rocks.

BACKGROUND ART

As the crushing apparatus, a self-propelled crushing machine can be exemplified (see Patent document 1, for instance). As shown in FIG. 18, the crushing machine includes a rotary crusher (crushing unit) 151 and a tub (rotary tub) 152 for feeding the rotary crusher 151 with wood (object to be crushed) that rotates around an independent shaft center. Incidentally, the tub 152 and the crusher 151 or the like are provided to a machine frame 153, and a traveling unit 154 is also provided to the machine frame 153. The wood (object to be crushed) is put into the tub 152 and crushed by the crusher 151, and the crushed articles are fed down below the crusher 151 to be discharged outward by a transport conveyor 155.

The wood as the object to be crushed often includes a tree branch, trunk, stump or the like and the hardness, size or the like thereof often varies, so that the crusher 151 may go in an overloaded state with some kinds of the object to be crushed and often stop, where the operating efficiency may be decreased.

In a wood-crushing machine according to the Patent document 1, a target crushing rotation speed by the crusher 151 is set, and when the actual rotation speed of the crusher 151 is higher than the target crushing rotation speed, the tub 152 is rotated in a forward direction at a predetermined rotation speed.

When the actual rotation speed of the crusher 151 is lower than the target crushing rotation speed but higher than a reference rotation speed that is lower than the target crushing rotation speed, the rotation speed of the tub 152 is gradually decreased from the predetermined rotation speed in the forward direction. And when the actual rotation speed of the crusher 151 is equal to or lower than the reference rotation speed, the tub 152 is stopped or rotated in the reverse direction.

Accordingly, it is prevented that too much objects to be crushed are fed to the crusher 151, thereby avoiding that the crusher goes in the overloaded state.

Patent document 1: Japanese Patent No. 3298829 (Pages 3 to 6, FIGS. 1, 3, 4, and 5)

DISCLOSURE OF THE INVENTION

Problems to be Solved by the Invention

In the control according to the Patent document 1, when the actual rotation speed of the crusher 151 is equal to or lower than the reference rotation speed, the feeding of the object to be crushed to the crusher 151 by the tub 152 is stopped, thereby stopping the crushing operation. Thus, the crusher 151 is put in a state for waiting for the actual rotation speed of the crusher 151 to recover so as to be higher than the reference rotation speed.

In this standby state for recovery, a large amount of hydraulic pressure for driving the crusher is relieved due to overloading. As a result, a longer period of time is required for recovery, decreasing the operating efficiency. Specifically, an output torque of a hydraulic motor is proportional to a motor capacity (an amount of oil required for one rotation) and the pressure, and since a relief set pressure and a motor capacity are constant, the output torque of the motor becomes constant at a predetermined value.

Therefore, the period of time required for recovery becomes long. Further, a loss in the hydraulic pressure is caused by the relief of the hydraulic circuit.

The present invention is accomplished to solve the above-described disadvantages, and an object of the present invention is to provide a crushing apparatus in which operating quantity can be improved by decreasing the feeding of the object to be crushed to the rotary crusher or by shortening down time.

Means for Solving the Problems

A crushing apparatus according to a first invention includes a rotary crusher, a hydraulic motor for rotating the rotary crusher, a feeder for feeding an object to be crushed to the rotary crusher, and a controller for controlling the feeder and the hydraulic motor, in which the hydraulic motor is a capacity-variable motor that can be switched between a predetermined capacity and a large capacity, the hydraulic motor including:

a load detector for detecting a loading state of the hydraulic motor;

a load judging device for judging whether the loading state of the hydraulic motor detected by the load detector is in an overloaded state or an underloaded state;

a feeding amount controller for decreasing or stopping a feeding by the feeder the object to be crushed when the load judging device judges as overloaded and for increasing or starting the feeding by the feeder the object to be crushed when the load judging device judges as underloaded; and a motor capacity controller for changing a capacity of the capacity-variable motor to the large capacity when the load judging device judges as overloaded.

In the first invention, when the hydraulic motor enters the overloaded state, a motor capacity controller sets the hydraulic motor to the large capacity, thereby the torque can be increased.

Specifically, since overload recovery acceleration of the hydraulic motor is proportional to the torque, the output torque is increased by setting to the large capacity in the hydraulic motor. Additionally, by setting the hydraulic motor to the large capacity, the relief amount can be decreased.

Therefore, a part of the hydraulic pressure that has been relieved when the feeding of the object to be crushed to the crusher is decreased or stopped can be utilized.

A crushing apparatus according to a second invention is the crushing apparatus according to the first invention, in which the motor capacity controller returns the capacity of the hydraulic motor to the predetermined capacity when the load judging device judges that the hydraulic motor is out of the overloaded state.

In the second invention, the hydraulic motor is returned to the predetermined capacity when the hydraulic motor gets out of the overloaded state. Specifically, when the hydraulic motor is out of the overloaded state, the torque does not need to be increased, so that the hydraulic motor can be returned to the former predetermined capacity, thereby fuel consumption becomes smaller.

A crushing apparatus according to a third invention is the crushing apparatus according to the first invention, in which the rotary crusher is driven by two hydraulic motors; and one of the hydraulic motors is the capacity-variable motor.

In the third invention, the two hydraulic motors are provided, so that each motor can be downsized, allowing easy layout of the hydraulic motors.

A crushing apparatus according to a fourth invention is the crushing apparatus according to the third invention, in which the other of the hydraulic motors is a capacity-switchable motor that can be switched between two positions respectively providing the large capacity and the predetermined capacity.

As discussed above, in this arrangement, the other of the hydraulic motors is a capacity-switchable motor that can be switched between two positions respectively providing the large capacity and the predetermined capacity.

In the fourth invention, since the other hydraulic motor is the capacity-switchable motor of which capacity can be switched between the large capacity and the predetermined capacity, the output torque can be increased by switching the capacity of the capacity-switchable motor to the large capacity and can be decreased by switching the capacity of the capacity-switchable motor to the predetermined capacity.

Therefore, by switching to the large capacity on a starting or the like, a quick starting can be realized. Furthermore, even if the capacity-switchable motor is switched to the large capacity with the purpose of crushing with high torque or the like, in a capacity-variable motor, the capacity-switchable motor can be controlled to operate with the large capacity in the standby state due to overloading before the feeding of the object to be crushed to the rotary crusher is started, so that the output torque is increased, thereby hasting the recovery of the rotation speed of the rotary crusher.

A crushing apparatus according to a fifth invention is the crushing apparatus according to the first invention, in which the capacity-variable motor is a control motor that changes the capacity by self-pressure.

In the fifth invention, since the capacity-variable motor is the control motor in which the capacity is changed by the self-pressure, the capacity-variable motor can be automatically switched to the large capacity in the standby state or the feeding-decreased state due to overloading before the feeding of the object to be crushed to the rotary crusher is started.

A crushing apparatus according to a sixth invention is the crushing apparatus according to the first invention, in which the feeding amount controller includes:

a crushing duration time measuring unit for measuring a crushing duration time between time points when the feeding of the object to be crushed is increased or started and when the feeding of the object to be crushed is decreased or stopped;

a time judging unit for judging whether the measured crushing duration time is longer than a predefined set time; and a feeding amount adjusting unit that decreases a capability of the feeder in a subsequent feeding process when the measured crushing duration time is equal to or shorter than the set time, and increases the capability of the feeder in the subsequent feeding process when the measured crushing duration time is longer than the set time.

A crushing apparatus according to a seventh invention is the crushing apparatus according to the sixth inventions, in which the feeder is a tub that is rotatably provided on an upper portion of the crusher, the tub rotating to feed the object to be crushed to the crusher; and the crushing duration time measuring unit measures a forward-rotation time of the tub which rotates in a direction for feeding the object to be crushed to the crusher to provide as the crushing duration time.

A crushing apparatus according to an eighth invention is the crushing apparatus according to the seventh inventions, in which an upper limit value and a lower limit value of the forward-rotation speed are set for the tub; and the feeding amount controller has a lower limit value setting unit for setting the lower limit value as a rotation marginal value at which the rotation of the tub is not stopped.

A crushing apparatus according to a ninth invention is the crushing apparatus according to the eighth invention, in which the feeding amount controller includes the feeding amount controller has an upper limit value setting unit for setting the preset rotation speed for the tub to the upper limit value of the rotation speed when the measured crushing duration time is judged to be longer than the set time.

Effect of the Invention

According to the crushing apparatus of the first invention, in the standby state or the feeding-decreased state due to overloading before the feeding of the object to be crushed to the rotary crusher is increased or started, the torque can be increased, thereby shortening the time before the rotation speed of the crusher is recovered to a predetermined rotation speed. Accordingly, the operating efficiency can be improved and the operating quantity can be increased. In addition, the part of the hydraulic pressure that has been relieved when the feeding of the object to be crushed to the crusher is stopped can be utilized, thereby decreasing the loss in the hydraulic pressure.

According to the crushing apparatus of the second invention, when the hydraulic motor is out of the overloaded state, the torque does not need to be increased, so that the hydraulic motor can be returned to the former predetermined capacity. Therefore, unnecessary operation can be avoided, decreasing the fuel consumption.

According to the crushing apparatus of the third invention, each motor can be downsized, thereby realizing downsizing as a whole and easy layout of the crusher, the motor or the like.

According to the crushing apparatus of the fourth invention, by switching, for instance, the capacity-switchable motor to the large capacity on a starting or the like, the starting can be performed quickly, thereby further improving the operating efficiency. Additionally, even if the capacity-switchable motor is switched to either the large capacity or the predetermined capacity, the hydraulic motor can be switched to the large capacity in the standby state due to overloading before the feeding of the object to be crushed to the rotary crusher is increased or started in the capacity-variable motor, thereby shortening the time before the rotation speed of the crusher is recovered to a predetermined rotation speed.

Accordingly, the operating efficiency can be improved and the operating quantity can be increased.

According to the crushing apparatus of the fifth invention, in the standby state or the feeding-decreased state due to overloading before the feeding of the object to be crushed to the rotary crusher is increased or started, the hydraulic motor can be automatically switched to the large capacity, so that automatically and securely shortening the time before the rotation speed of the crusher is recovered to the predetermined rotation speed, thereby improving reliability in increasing the operating quantity.

According to the crushing apparatus of the sixth invention, the feeding amount adjusting unit is provided, thereby operation of the crusher in the overloaded state can be avoided. Thus, the operating efficiency can be improved, the burden on the crusher is reduced and the crusher can be prevented from being damaged. Further, the feeding amount to the crusher can be optimized in accordance with crushing duration time.

Thus, the operating time of the crusher can be maximized, so that the crushing operation can be performed effectively, thereby obtaining improvements in a total crushing amount (operating quantity). Furthermore, the crushing apparatus of the sixth invention recognizes the load on the crusher periodically on the duration time basis, unlike the Patent document 1 in which the load on the crusher is recognized instantly on the moment-to-moment basis, thereby allowing more precise controlling.

According to the crushing apparatus of the seventh invention, the crushing duration time can be easily sensed, so that the feeding amount of the object to be crushed to the crusher can be securely optimized.

According to the crushing apparatus of the eighth invention, the rotation speed of the tub cannot exceed the upper limit value. Hence, it can be prevented that the feeding amount of the object to be crushed (wood) to the crusher exceeds a preset vale, thereby ensuring the safety.

The lower limit value of the rotation speed of the tub is set by a lower limit value setting unit to a rotation marginal value at which the rotation of the tub is not stopped, so that the tub is surely rotated even at a low speed. Therefore, even if the rotation speed of the tub is reduced by the control of the apparatus, the object to be crushed (wood) can be fed to the crusher such that the crusher can perform the crushing operation of the object to be crushed, thereby preventing a reduction in the operating quantity.

On the other hand, in an apparatus in which the rotation of the tub is stopped, an operator cannot distinguish whether the apparatus is stopped (crushing operation is stopped) or the tub is stopped due to overloading, countermeasures taken in such a circumstance may not be appropriate, reducing the workability.

According to the crushing apparatus of the ninth invention, the feeding amount of the object to be crushed to the crusher can be optimized in accordance with a preset value by an upper limit value setting unit. Hence, the crushing operation can be performed efficiently, thereby obtaining improvements in the operating quantity. In addition, the burden on the tub motor can be reduced, thereby realizing excellent durability of the crushing apparatus.

EXPLANATION OF CODES

1: rotary crusher; 1A, 201A, 301A: hydraulic motor (capacity-variable motor); 1B, 201B: capacity-switchable motor; 2: tub (feeder); 30: controller; 34: feeding amount controller; 161D, 303: load detector; 331: motor capacity controller; 341: crushing duration time measuring unit; 342: time judging unit; 343: feeding amount adjusting unit; 344: lower limit value setting unit; 345: upper limit value setting unit

BEST MODE FOR CARRYING OUT THE INVENTION

First Embodiment

[1] Overall Arrangement

Figure 1:
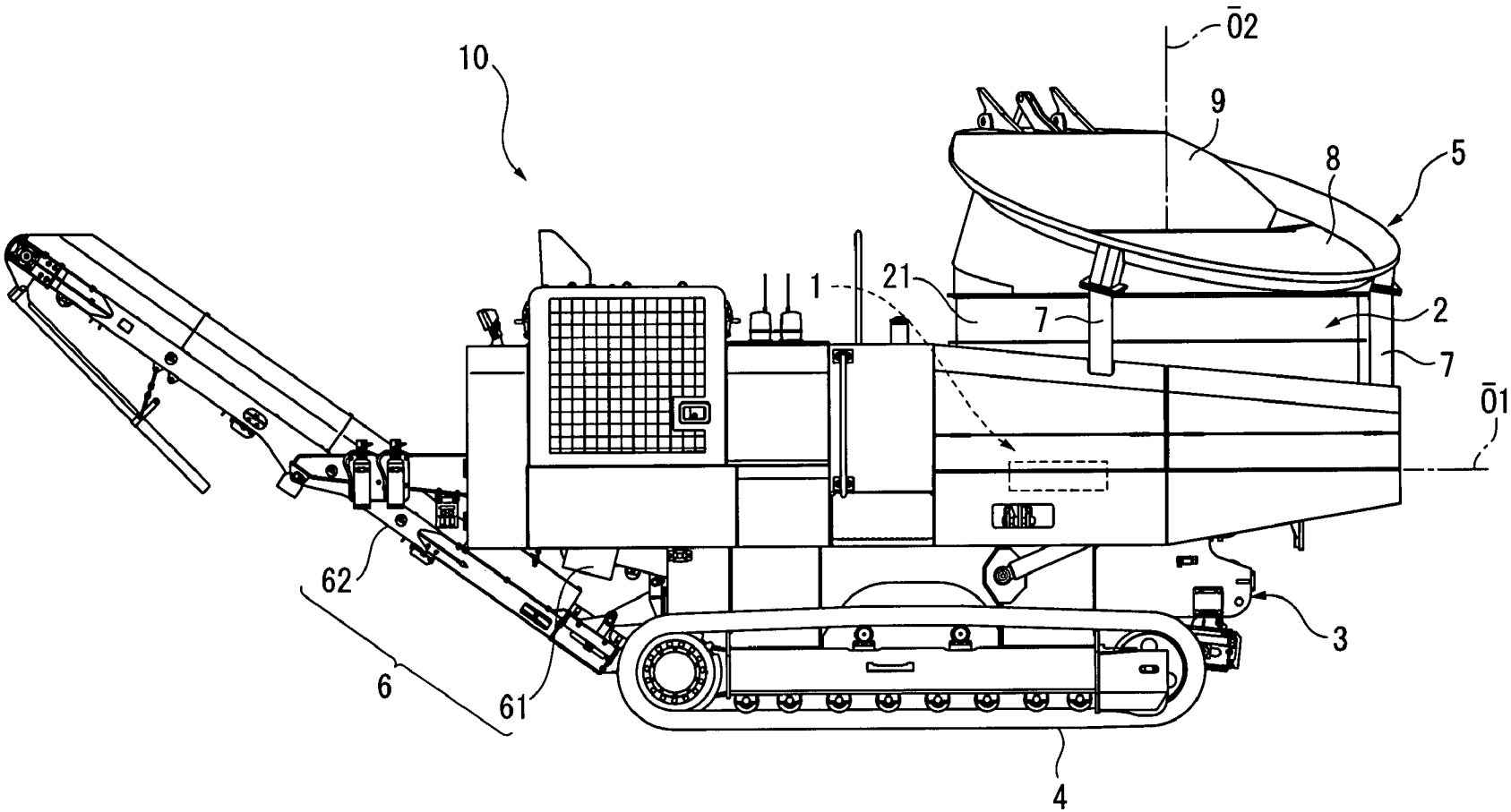
FIG. 1 is a side view showing a wood-crushing apparatus according to a first embodiment of the present invention.

Embodiments of the crushing apparatus according to the present invention will be described below in detail in reference to the drawings. FIG. 1 is a side view of a wood-crushing apparatus and FIG. 2 is a rear view thereof.

This wood-crushing apparatus is self-propelled type and is provided with a crusher 1 and a substantially cylindrical tub (rotary tub) 2 that rotates around a shaft axis O2 for feeding wood to the crusher 1.

A tub-receiving frame for holding the tub 2 around the shaft axis, the crusher 1 and the like are provided on a machine bed (machine body) 3 to which a traveling unit 4 is provided. The tub 2 includes a hopper (fixed hopper) 5 at an upper opening thereof, and by putting the wood into the hopper 5, the wood is fed in the tub 2.

Figure 2:
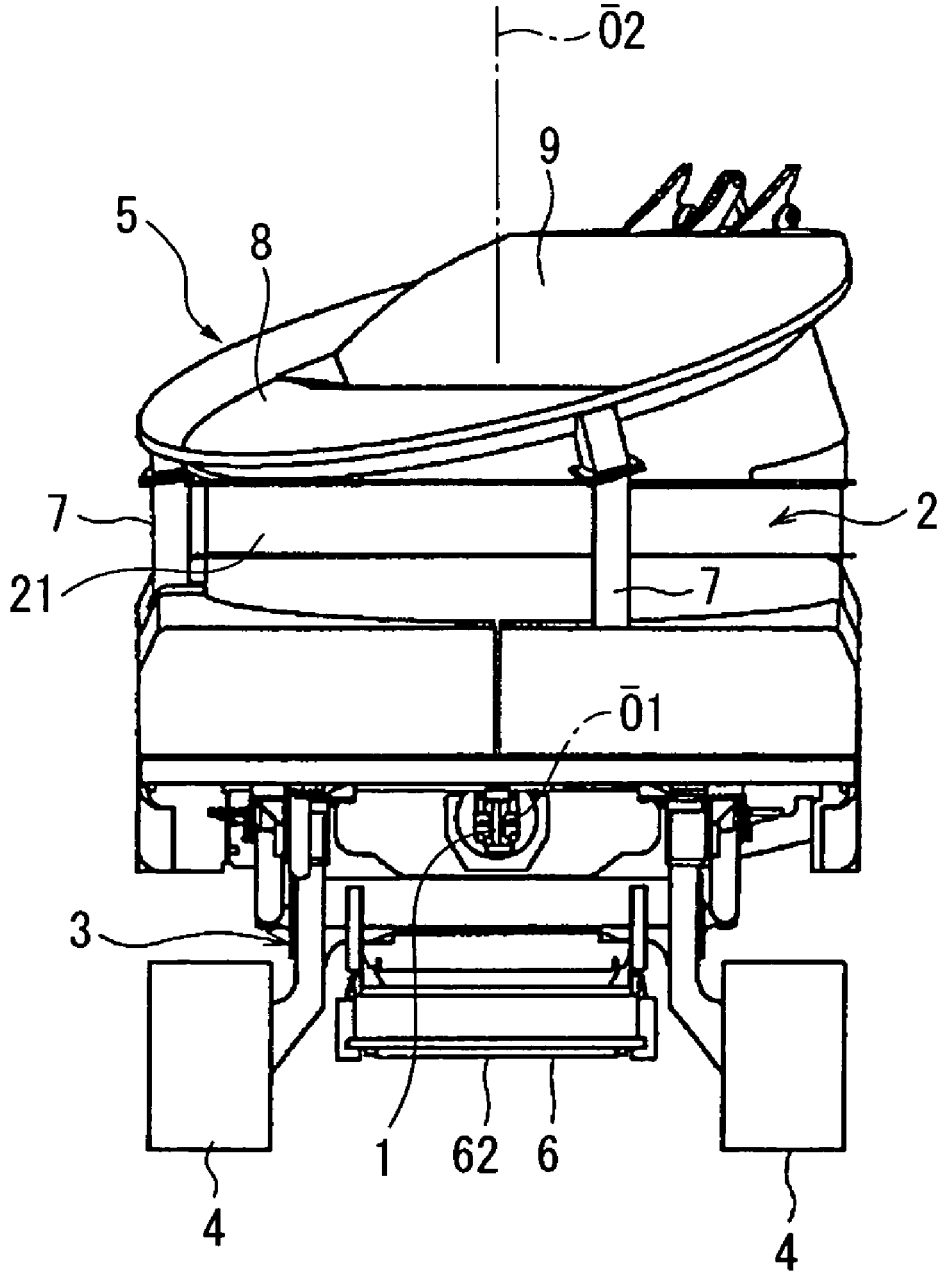
FIG. 2 is a rear view of the wood-crushing apparatus according to the first embodiment.

As shown in FIGS. 1 and 2, the crusher 1 includes a rotation shaft that rotates around an axis O1 extending in a traveling direction of the wood-crushing apparatus and a crusher main unit that rotates together with the rotation shaft. The crusher main unit has blades called bits that are implanted on a outer peripheral surface of a cylindrical rotary drum, and each end of the rotation shaft has a first hydraulic motor and a second hydraulic motor (described below) connected thereto to rotate the crusher main unit.

The tub 2 has the tub-receiving frame disposed on the machine bed and a tub main unit 21 rotatably supported around the shaft axis O2 on the tub-receiving frame.

Although not shown in the figures, the tub main unit 21 has a sprocket disposed adjacent to a bottom portion of an outer peripheral surface thereof, and a looped chain CH (described below) is meshed with the sprocket. The looped chain CH is also meshed with a gear for driving at an end, and to the center of rotation of the gear, a rotation shaft of a tub motor (described below) is connected.

When the wood is fed to the tub 2, the wood is fed to the crusher 1 as the tub 2 rotates, and then the crusher 1 crushes the wood. The crusher 1 crushes the wood into wood chips of a predetermined particle size and the chips are discharged via a screen (not shown) to a first conveyor 61 disposed below the crusher 1 and then discharged outwardly by a second conveyor 62. In other words, the first conveyor 61 and the second conveyor 62 work together as a transport conveyor 6 to discharge the crushed wood chips to the outside. Incidentally, in the wood-crushing apparatus, a crawler mounted traveling unit is employed as the traveling unit 4, but a tire-mounted traveling unit may also be employed. The traveling unit 4 may not be provided and the wood-crushing apparatus may be a stationary type or a transportable type.

Hereinafter, a side to which the transport conveyor 6 is protruding is called a front side, while the opposite side thereof i.e. a side to which the transport conveyor 6 is not protruding is called a back side.

In the back side of the machine bed 3, the tub 2 can be rotated around the shaft axis O2 by a driving unit, and the hopper 5 is supported by poles 7 upstanding on the tub-receiving frame mounted on the machine bed 3 and a lower end thereof is movably fit onto an upper end of the tub 2.

In a lower portion of the tub 2, the above-described crusher 1 is provided.

The hopper 5 has an input slot 8 inclined to the horizontal plane, and the input slot 8 has a scattering prevention cover 9 to cover a portion thereof.

In a substantially middle portion on the machine bed 3, an engine room 10 is provided. The engine room 10 has an engine as a power source, hydraulic pumps, a hydraulic oil tank, operating valves and a controller (not shown). Incidentally, the controller is electrically connected to an operation panel (not shown) on which the operator can make settings for crushing and tub rotation in order to set crushing conditions and tub rotation conditions appropriate for each object to be crushed.

The operating valve is connected via piping lines to the above-described crusher 1, tub 2, traveling unit 4 and hydraulic motors as a driving source for the transport conveyor 6, so that the crusher 1 and so on can be operated by starting the engine to distribute pressure oil to the hydraulic motors by the hydraulic pumps.

[2] Arrangement of Hydraulic Circuit (2-1) Overall Arrangement of Hydraulic Circuit An arrangement of hydraulic circuit from the engine room 10 to each hydraulic motor will be schematically described below in reference to FIG. 3.

The engine room 10 includes the engine 11, a fan 12, a main pump 13, the hydraulic oil tank 14, an oil cooler 15 and an operating valve 16.

The engine 11 has an engine main body (not shown) such as a diesel engine and a radiator (not shown) for cooling the engine main body and the engine 11 is cooled by the fan 12 provided thereto.

To the engine 11, a fuel oil tank is connected via a fuel feed pipe and a battery is connected via an electric wiring, and the engine starts driving by the battery while receiving a fuel feed from the fuel oil tank.

The main pump 13 has a first hydraulic pump 131, a second hydraulic pump 132 and a third hydraulic pump 133 that are driven by the engine 11, so that hydraulic oil is squeeze-pumped from each of the pumps 131 to 133 via piping lines 101 to 103 to the operating valve 16.

Figure 3:
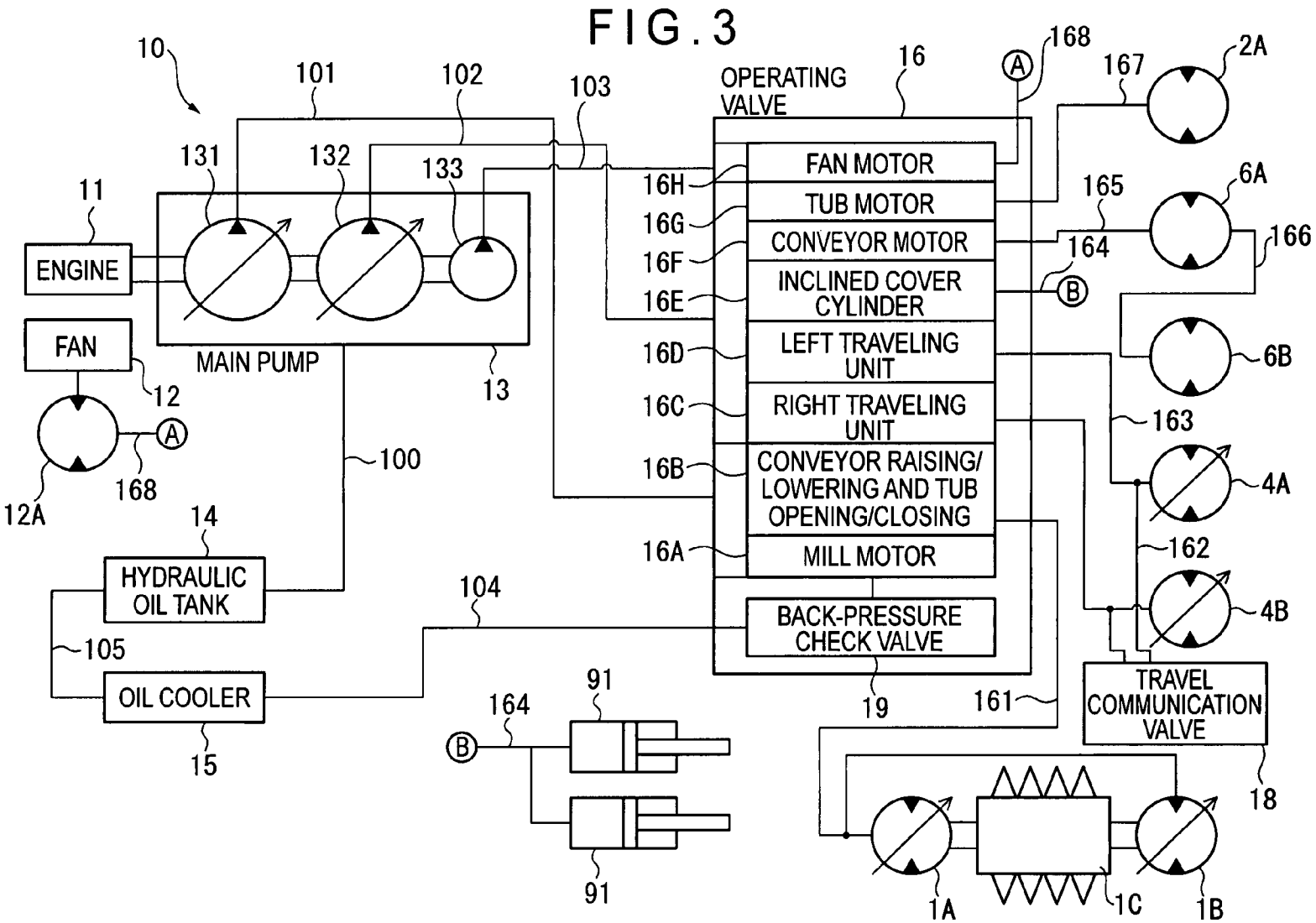
FIG. 3 is a schematic illustration showing a hydraulic circuit of the wood-crushing apparatus according to the first embodiment.

The operating valve 16 also works as a distributor for supplying the hydraulic oil to the hydraulic motors of the above-described components in accordance with switching operations, and such switching control is performed by the controller (not shown) in FIG. 3.

The operating valve 16 is connected at a downstream thereof via the piping lines 161 to 168 to the hydraulic motor or the like of each component.

In the present embodiment, provided as a hydraulic motor are a fan motor 12A for driving the fan 12, a tub motor 2A for driving the tub 2, conveyor motors 6A and 6B for driving the transport conveyor 6, a left traveling unit motor 4A and a right traveling unit motor 4B for driving the traveling unit 4 and a first hydraulic motor 1A and a second hydraulic motor 1B for driving the crusher 1 as a mill motor. The operating valve 16 is also connected to opening/closing cylinders 91 for the scattering prevention cover 9, a conveyor raising/lowering cylinder (not shown) and a tub opening/closing cylinder (not shown) such that the scattering prevention cover 9 can be opened or closed, the transport conveyor 6 can be raised or lowered, and the tub 2 can be opened or closed by switching the operating valve.

Specifically, in the arrangement of the hydraulic circuit, the main pump 13 is supplied with the hydraulic oil by the hydraulic oil tank 14 to which the main pump 13 is connected via the piping line 100.

The first hydraulic pump 131 has a capacity-variable pump that can change an amount of oil to be sent, and is connected to a mill-motor-operating valve 16A and a cylinder-operating valve 16B for raising/lowering the conveyor and opening/closing the tub of the operating valve 16. The mill-motor-operating valve 16A is connected via the piping line 161 to the first hydraulic motor 1A and the second hydraulic motor 1B of the crusher 1.

The first hydraulic motor 1A and the second hydraulic motor 1B are connected to the rotation shaft of the crusher 1 and the rotary crushing unit 1C is rotated by the rotation of the rotation axis, thereby the wood is crushed.

The second hydraulic pump 132 also has a capacity-variable pump, and is connected via the piping line 102 to a right traveling unit operating valve 16C and a left traveling unit operating valve 16D, an inclined cover cylinder operating valve 16E, a conveyor-motor-operating valve 16F and a tub-motor-operating valve 16G of the operating valve 16.

The right traveling unit operating valve 16C is connected via the piping line 162 to the right traveling unit motor 4B, while the left traveling unit operating valve 16D is connected via the piping line 163 to the left traveling unit motor 4A. Between the piping lines 162 and 163, a travel communication valve 18 is provided for adjusting balance between the traveling units.

The inclined cover cylinder operating valve 16E is connected via the piping line 164 to the opening/closing cylinder 91 to the scattering prevention cover 9.

The conveyor-motor-operating valve 16F is connected via the piping line 165 to the conveyor motor 6A for driving the first conveyor 61, and the conveyor motor 6A is further connected via the piping line 166 to the conveyor motor 6B for driving the second conveyor 62.

The tub-motor-operating valve 16G is connected via the piping line 167 to the tub motor 2A for driving the tub 2.

The third hydraulic pump 133 has a constant volume pump, and is connected via the piping line 103 to a fan-motor-operating valve 16H. The fan-motor-operating valve 16H is connected via the piping line 168 to the fan motor 12A. Incidentally, the fan motor 12A works as a driving source for rotating a fan for cooling the engine.

The oil sent from the operating valves 16 is returned, after driving each hydraulic motor, through a back-pressure check valve 19 to an oil cooler 15 via the piping line 104, where the oil is cooled down and then to the hydraulic oil tank 14 via the piping line 105.

(2-2) Hydraulic Circuit of Tub Motor 2A

A hydraulic circuit of the tub motor 2A that is the driving source of the tub 2 will be described below in detail.

Figure 4:
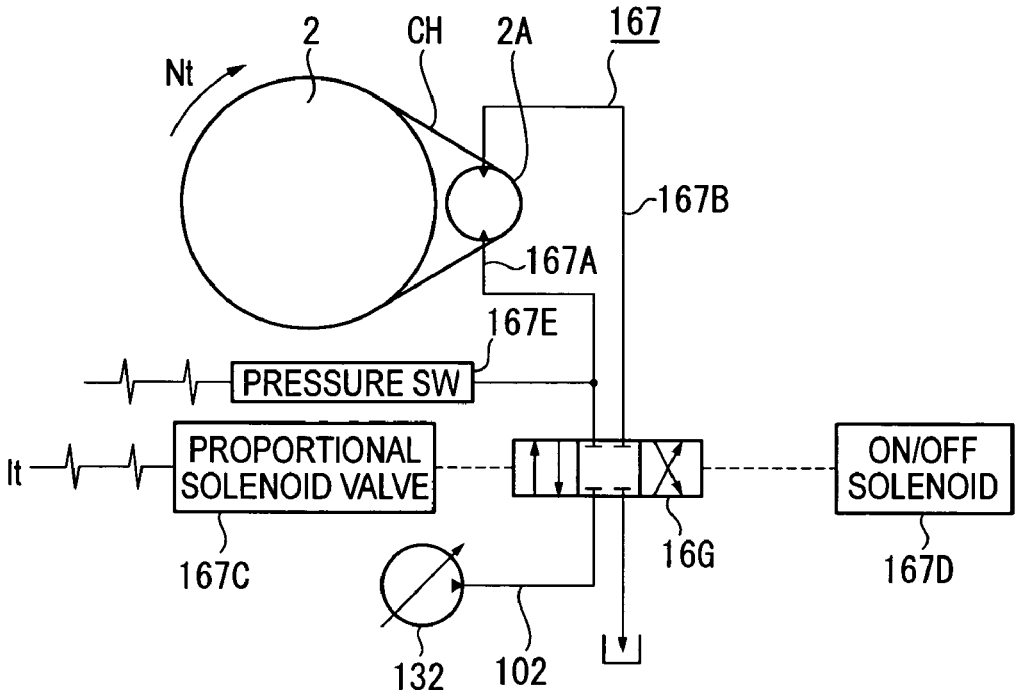
FIG. 4 is another schematic illustration showing a primary portion of a hydraulic circuit for tub control according to the first embodiment.

FIG. 4 shows a hydraulic circuit on the tub 2 side. In FIG. 4, the component indicated by the reference numeral 2 is a tub that is rotated and the component indicated by 2A is a tub motor for driving, and, as described above, the tub motor 2A drives the tub 2 using the chain CH.

The piping line 102 from the second hydraulic pump 132 is connected to the tub-motor-operating valve 16G which includes a control valve for flow rate and flow direction having four ports and three switching positions.

The piping line 167 from the tub-motor-operating valve 16G to the tub motor 2A is constituted of a pump line 167A and a tank line 167B that are connected to the tub motor 2A.

The tub-motor-operating valve 16G to which the pump line 167A and the tank line 167B are connected further includes a proportional solenoid valve 167C.

In addition, a solenoid 167D is also connected to the tub-motor-operating valve 16G. Incidentally, a component indicated by the reference numeral 167E is a pressure switch.

Figure 5:
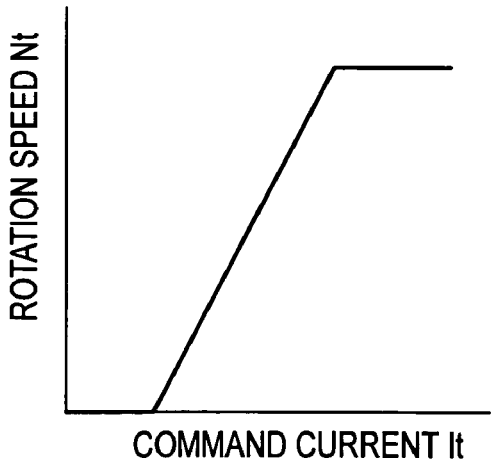
FIG. 5 is a graph showing a relation between a command current and a tub rotation speed in the control of the tub according to the first embodiment.

As shown in FIG. 5, the tub 2 is rotated at a rotation speed Nt substantially proportional to a command current It to the proportional solenoid valve 167C.

(2-3) Hydraulic Circuit of Crusher 1

A hydraulic circuit of the first hydraulic motor 1A and the second hydraulic motor 1B that is the driving sources of the crusher 1 will be described below in detail.

Figure 6:
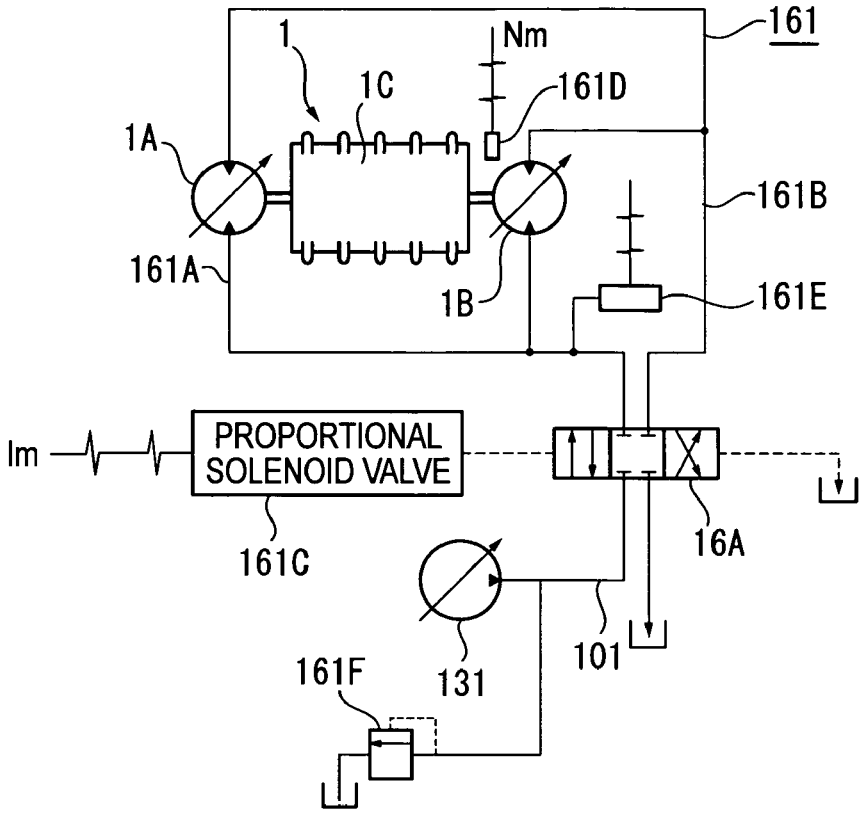
FIG. 6 is still another schematic illustration showing a primary portion of a hydraulic circuit for crusher control according to the first embodiment.

FIG. 6 shows a hydraulic circuit on the crusher 1 side. In FIG. 6, the component indicated by the reference numeral 1C is a rotary crushing unit to be rotated, and the rotary crushing unit 1C is driven by a pair of the hydraulic motor 1A and the hydraulic motor 1B connected to each end of the rotary crushing unit 1C.

One of the pair, the first hydraulic motor 1A is a capacity-variable motor that can switch the capacity thereof by the self-pressure between a predetermined capacity and a large capacity greater than the predetermined capacity.

The other of the pair, the second hydraulic motor 1B is a capacity-switchable motor that switches between large and small of an inclination angle in order to switch between a predetermined capacity and a large capacity greater than the predetermined capacity.

In the present embodiment, the first hydraulic motor 1A of which capacity is automatically switched in accordance with the self-pressure works as the load detector, the load judging device and the motor capacity controller of the present invention.

The piping line 101 from the first hydraulic pump 131 is connected to the mill-motor-operating valve 16A which includes the control valve for flow rate and flow direction having four ports and three switching positions The piping line 161 from the mill-motor-operating valve 16A to the first hydraulic motor 1A and the second hydraulic motor 1B is constituted of a pump line 161A and a tank line 161B that are connected to the first hydraulic motor 1A and the second hydraulic motor 1B respectively.

The first hydraulic motor 1A and the second hydraulic motor 1B are connected in parallel to the pump line 161A and the tank line 161B respectively. The mill-motor-operating valve 16A to which the pump line 161A and the tank line 161B are connected further includes a proportional solenoid valve 161C. Incidentally, a component indicated by the reference numeral 161D is a rotation sensor for detecting a rotation speed of the rotary crushing unit 1C and a component indicated by 161E is a pressure switch.

The piping line 101 from the first hydraulic pump 131 has a relief valve 161F inserted thereto for regulating a maximum pressure of the pump line 161A.

Figure 7:
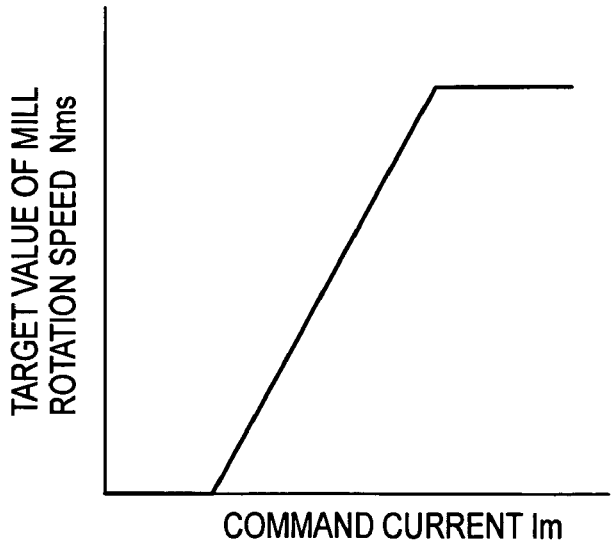
FIG. 7 is another graph showing a relation between a command current and a crusher rotation speed in the control of the crusher according to the first embodiment.

As shown in FIG. 7, the rotary crushing unit 1C is driven such that the rotary crushing unit 1C is rotated at a rotation speed Nms (a desired value) substantially proportional to a command current Im to the proportional solenoid valve 161C.

[3] Control Structure of Hydraulic Circuit

Figure 8:
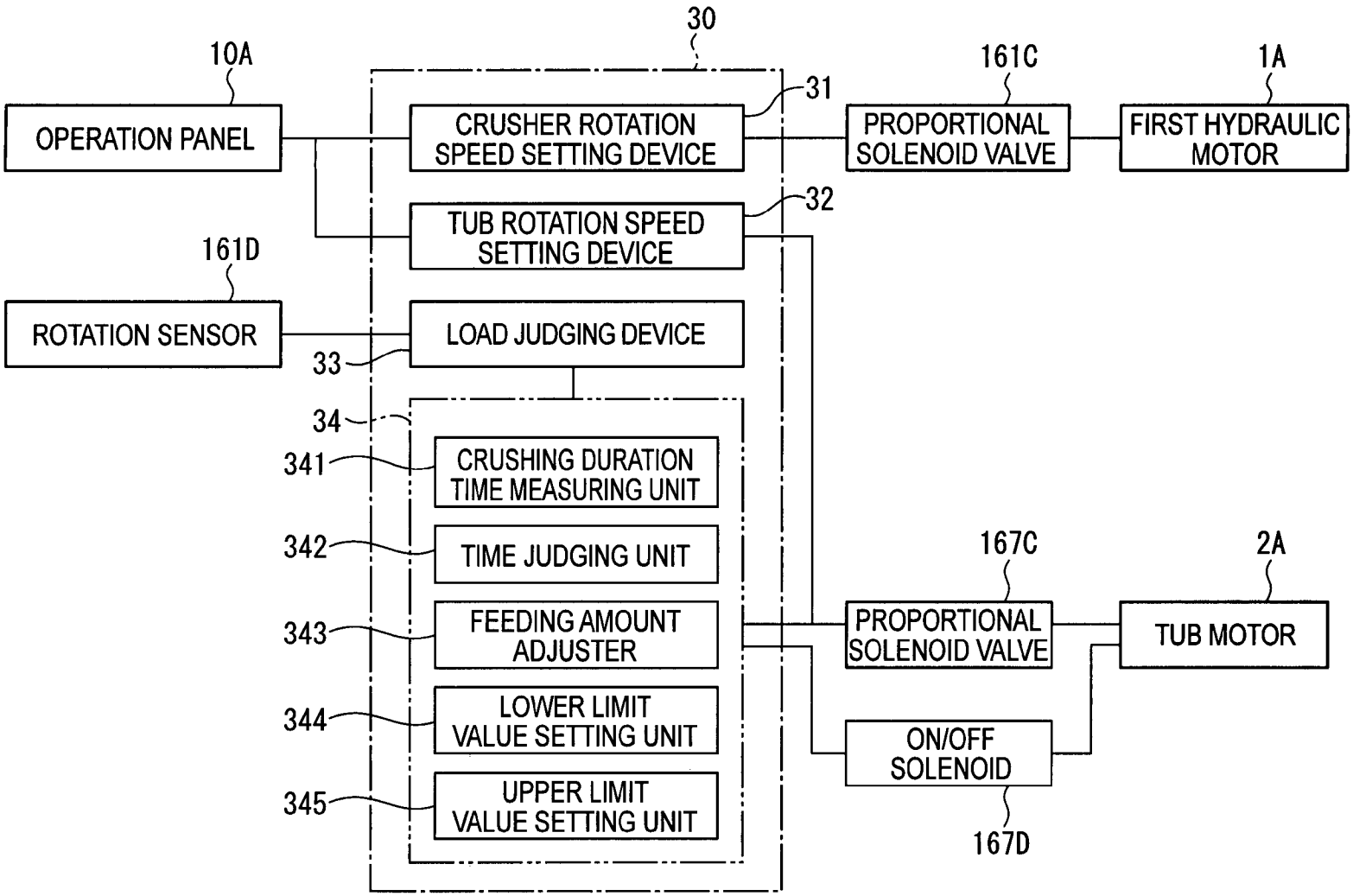
FIG. 8 is a functional block diagram showing a structure of a controller according to the first embodiment.

The above-described hydraulic circuit of the tub motor 2A of the tub 2 and hydraulic circuit of the first hydraulic motor 1A and the second hydraulic motor 1B of the crusher 1 are controlled by a controller 30 as shown in FIG. 8 based on the preset rotation speeds of the first hydraulic motor 1A and the second hydraulic motor 1B that are set on an operation panel 10A disposed in the engine room 10 as well as the rotation speeds of the first hydraulic motor 1A and the second hydraulic motor 1B that are detected by the rotation sensor 161D.

The controller 30 includes a computer, and further includes a crusher rotation speed setting device 31, a tub rotation speed setting device 32, a load judging device 33 and a feeding amount controller 34 that are executed as software on a processing unit of the computer.

The crusher rotation speed setting device 31 generates a current signal Im based on a preset rotation speed Nmso of the crusher 1 that is set by the operator on the operation panel 10A, and then outputs the generated current signal Im to the proportional solenoid valve 161C in order to allow the proportional solenoid valve 167C to supply the hydraulic oil in accordance with the preset rotation speed Nmso.

The tub rotation speed setting device 32 generates a current signal It based on a preset rotation speed of the tub 2 that is set by the operator on the operation panel 10A, and then outputs the generated current signal It to the proportional solenoid valve 167C in order to allow the proportional solenoid valve 161C to supply the hydraulic oil in accordance with the preset rotation speed.

The load judging device 33 judges whether the crusher 1 is in an overloaded state or in an underloaded state based on the rotation speed signal Nm of the rotary crushing unit 1C output by the rotation sensor 161D provided in the crusher 1.

Although described below in detail, the load judging device 33 judges that the crusher 1 is in an overloaded state when the rotation speed Nm of the rotary crushing unit 1C detected by the rotation sensor 161D is less than 70% of the preset rotation speed Nmso set on the operation panel 10A, that the crusher 1 is in a constant load state when the rotation speed Nm is equal to or over 70% but does not exceed 90%, and that the crusher 1 is in an overloaded state when the rotation speed Nm is over 90%.

Judgment results by the load judging device 33 are output to the feeding amount controller 34.

The feeding amount controller 34 controls the feeding amount of wood by the tub 2 to the crusher 1 by controlling the drive of the tub motor 2A based on the detection state by the rotation sensor 161D.

Although details will be described below, when the crusher 1 is judged to be in the overloaded state by the load judging device 33, the feeding amount controller 34 stops the feeding of wood to the crusher 1 until the crusher 1 gets out of the overloaded state into the underloaded state, while when the crusher 1 is judged to be in the underloaded state, the feeding amount controller 34 increases the feeding amount of wood to the crusher 1. The feeding amount of wood by the tub 2 can be increased or decreased by changing a control signal to the proportional solenoid valve 167C provided to the piping line 167 which is connected to the tub motor 2A. Incidentally, the feeding amount controller 34 includes a portion working as a time measuring unit such that the feeding amount controller 34 can change an output current to the proportional solenoid valve 167C in accordance with a count value of a timer.

Concretely, the feeding amount controller 34 has a crushing duration time measuring unit 341, a time judging unit 342, a feeding amount adjusting unit 343, a lower limit value setting unit 344 and an upper limit value setting unit 345.

The crushing duration time measuring unit 341 measures a crushing duration time between the time points when the feeding of the object to be crushed is increased or started and when the feeding of the object to be crushed is decreased or stopped, and the measurement of the duration time is performed using a timer circuit provided in the controller 30.

The time judging unit 342 judges whether the crushing duration time $t_1$ measured by the crushing duration time measuring unit 341 is longer than a predefined set time $t_{10}$ or not, and if the time $t_1$, is longer than the set time $t_{10}$, the time judging unit 342 outputs a message signal to the feeding amount adjusting unit 343.

The feeding amount adjusting unit 343 adjusts the feeding capacity of the tub 2 based on the crushing duration time measured by the crushing duration time measuring unit 341, and in concrete, the adjustment of the feeding amount is performed as described below.

(1) When the measured crushing time $t_1$, is equal to or shorter than the set time $t_{10}$, the subsequent feeding capability of the tub 2 will be decreased. Specifically, the command current Itm to the tub 2 increased by a constant current value Δ Ito is written in a memory for recording the command current so as to be the subsequent command current.

(2) When the measured crushing time $t_1$ is longer the set time $t_{10}$, the subsequent feeding capability of the tub 2 will be increased. Specifically, the command current Itm to the tub 2 decreased by the constant current value Δ Ito is written in the memory for recording the command current so as to be the subsequent command current.

The lower limit value setting unit 344 sets a lower limit value of the rotation speed that is set for the tub 2, and the lower limit value is set as the rotation marginal value at which the tub 2 does not rotate. Specifically, the lower limit value is set depending on whether the command current Itm set by the feeding amount adjusting unit 343 is smaller than the lower limit value Itmin or not, and when the command current Itm is smaller than the lower limit value Itmin, that command current Itm is recorded in a memory as the lower limit value Itmin in order to update the setting of the lower limit value Itmin.

The upper limit value setting unit 345 updates the setting of the upper limit value of the rotation speed based on the judgment made by the time judging unit 342. Specifically, the upper limit value setting unit 345 judges whether the command current Itm that has been increased by the feeding amount adjusting unit 343 is larger than the upper limit value Ito recorded in the memory, and when the command current Itm is larger, that command current is recorded in a memory as a new upper limit value Ito in order to update the setting of the upper limit value Ito.

[4] Control of Tub 2 and Crusher 1 by Controller 30

Controls of the tub 2 and the crusher 1 will be described below in reference to the flowcharts shown in FIGS. 9 and 10.

(4-1) Control of Tub 2

Figure 9:
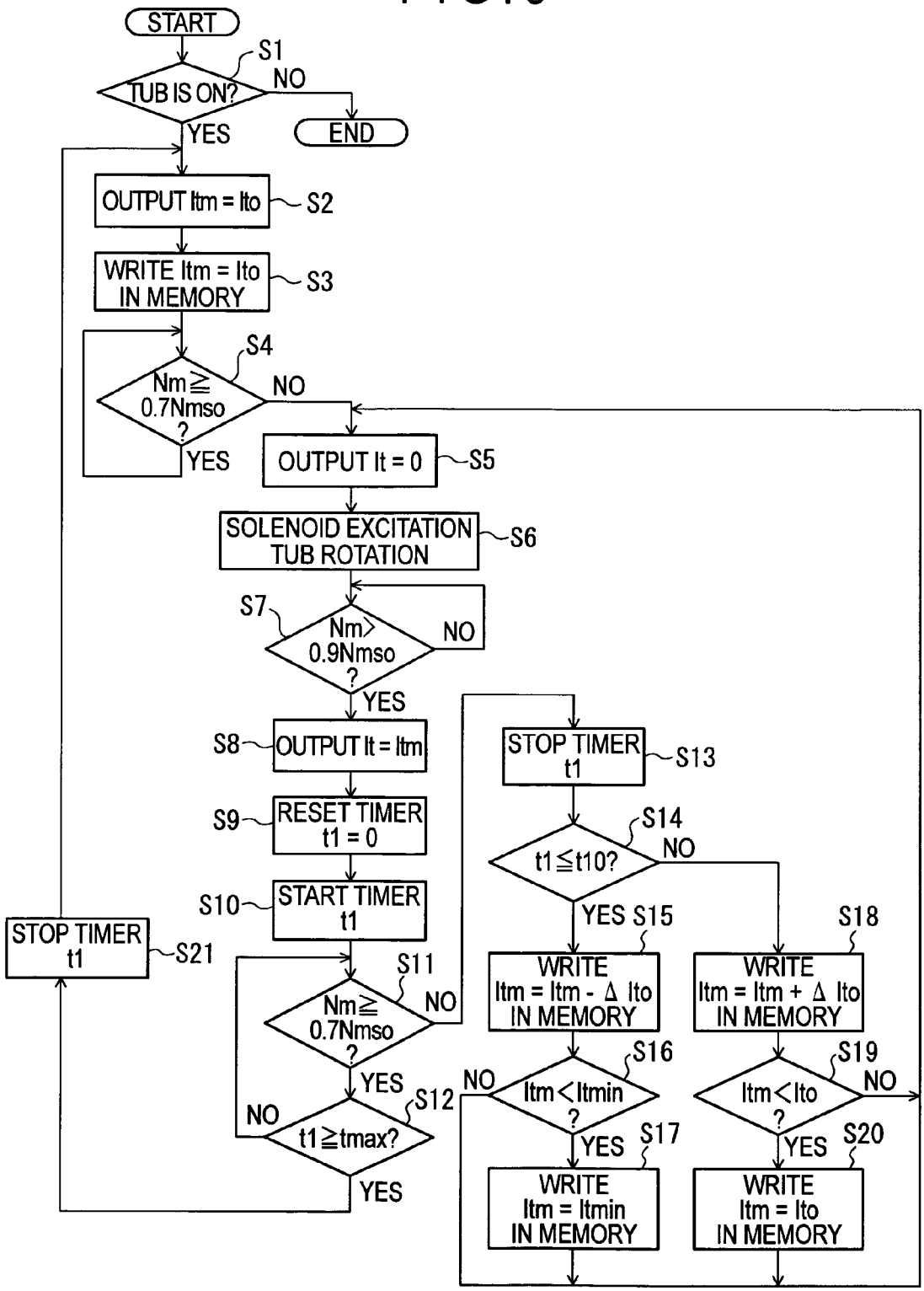
FIG. 9 is a flowchart showing tub controlling operations according to the first embodiment.

Control of the tub 2 is performed based on the flowchart shown in FIG. 9.

(1) In the step S1, the feeding amount controller 34 of the controller 30 checks that the tub 2 is operating, i.e. the operation switch is on. In the step S2, the command current It to the proportional solenoid valve 167C of the tub 2 is set to the command upper limit value Ito and the feeding of the object to be crushed is started (It=Ito).

(2) The feeding amount controller 34 inputs in the memory that the command current Itm of the time when the rotation of the tub 2 is restarted is the command upper limit value Ito (step S3).

(3) In the step S4, the load judging device 33 judges whether the rotation speed Nm of the rotary crushing unit 1C detected by the rotation sensor 161D is equal to or over 70% of the preset rotation speed Nmso or not.

(4) If the load judging device 33 judges that the detected rotation speed Nm of the crusher 1 is equal to or over 70% of the preset rotation speed Nmso, i.e. the crusher 1 is not in the overloaded state, such state (operating state of the crusher 1) is kept.

(5) On the other hand, if the load judging device 33 judges that the detected rotation speed Nm of the crusher 1 is less than 70% of the preset rotation speed Nmso, i.e. the crusher 1 is in the overloaded state, the control process goes to the step S5 in which the feeding amount controller 34 stops the tub 2 by zeroing the command current It to the proportional solenoid valve 167C in order to halt the feeding of the object to be crushed.

(6) Subsequently, the feeding amount controller 34 excites the solenoid 167D for a predetermined period of time (approximately one second) to reversely rotate the tub 2 (step S6). When the predetermined period of time has elapsed, the excitation of the solenoid 167D is stopped and the tub-motor-operating valve 16G is switched to the tub stop position, where the tub 2 is kept stopped. Thus, the object to be crushed (wood) is not fed to the crusher 1, so that the loads on the mill motors 1A and 1B are reduced, where the rotation speed Nm of the rotary crushing unit 1C gradually increases.

(7) In the step S7, the load judging device 33 judges whether the rotation speed Nm of the rotary crushing unit 1C detected by the rotation sensor 161D is over 90% of the preset rotation speed Nmso or not. If the rotation speed Nm is equal to or less than the preset rotation speed Nsmo, the load judging device 33 keeps the state, while if the rotation speed Nm is over 90%, the load judging device 33 determines that the state is the underloaded state and the control process proceeds to the step S8.

(8) In the step S8, the feeding amount controller 34 outputs the command current It to the proportional solenoid valve 167C of the tub 2 at the same value as the command current Itm of the time when the rotation of the tub 2 is restarted that has been recorded in the memory in the step S3 in order to restart the rotation of the tub 2 and the feeding of the object to be crushed.

(9) Subsequently, the crushing duration time measuring unit 341 of the feeding amount controller 34 resets the timer ($t_1$, =0) in the step S9 and starts the timer in the next step S10.

(10) In the step S11, the load judging device 33 judges whether the rotation speed Nm of the rotary crushing unit 1C detected by the rotation sensor 161D is equal to or over than 70% of the preset rotation speed Nmso or not. If the detected rotation speed Nm is equal to or over 70% of the preset rotation speed Nmso, such state (operating state of the crusher 1) is kept, and the control process proceeds to the step S12. On the other hand, if the detected rotation speed Nm is less than 70%, the feeding amount controller 34 stops the timer, and the control process proceeds to the step S14.

(11) In the step S14, the time judging unit 342 of the feeding amount controller 34 judges whether the count value $t_1$, of the timer is equal to or shorter than the set time $t_{10}$ or not.

(12) In the step S14, if the count value $t_1$, is equal to or shorter than the set time $t_{10}$ ($t_1 \leqq t_{10}$), the control process goes to the step S15 in which the feeding amount adjusting unit 343 of the feeding amount controller 34 writes in the memory the command current Itm of the time when the rotation of the tub 2 is restarted next time as the command current value decreased by the constant current value A Ito from the command current Itm of the time when the rotation of the tub 2 was restarted this time (Itm=Itm−ΔIto).

(13) In the step S16, the lower limit value setting unit 344 of the feeding amount controller 34 judges whether the command current Itm for the next time is less than the command lower limit value Itmin or not.

(14) If the lower limit value setting unit 344 of the feeding amount controller 34 judges that the command current Itm for the next time is less than the command lower limit value Itmin (Itm<Itmin) in the step S16, the command current Itm for the next time is set to the command lower limit value Itmin (Itm=Itmin) in the step S17, and the control process proceeds to the step S5. On the other hand, if the command current Itm for the next time is not less than the command lower limit value Itmin, the control process goes to the step S5 in which the command current It to the proportional solenoid valve 167C is zeroed to stop the tub 2, so that the feeding of the object to be crushed is halted, and subsequently in the step S6, the solenoid 167D is excited for the predetermined period of time (approximately one second) to reversely rotate the tub 2. The above-mentioned command lower limit value Itmin is set to the rotation marginal value at which the tub 2 does not stop the rotation thereof.

(15) In the step S14, if the count value $t_1$, is longer than the set time $t_{10}$ ($t_1$, $>t_{10}$), the control process goes to the step S18 in which the feeding amount adjusting unit 343 of the feeding amount controller 34 writes in the memory the command current Itm of the time when the rotation of the tub 2 is restarted next time as the command current value increased by the constant current value Δ Ito to the command current Itm of the time when the rotation of the tub 2 was restarted this time (Itm=Itm+ΔIto).

(16) In the step S19, the upper limit value setting unit 345 of the feeding amount controller 34 judges whether the command current Itm for the next time is over the command upper limit value Ito or not, and if the command current Itm for the next time is over the command upper limit value Ito (Itm>Ito), the command current Itm for the next time is set to the command upper limit value Ito (Itm=Ito) in the step S20, while if not over the command upper limit value Ito, the control process goes to the step S5.

(17) In the step S11, if the rotation speed Nm of the rotary crushing unit 1C detected by the rotation sensor 161D is equal to or over 70% of the preset rotation speed Nmso and accordingly the load judging device 33 judges that the crusher 1 is not in the overloaded state, the control process goes to the step S12 while keeping such state (operating state of the crusher 1), and in the subsequent the step S12, the time judging unit 342 of the feeding amount controller 34 judges whether the count time $t_1$, is equal to or longer than the upper limit set time $t_{max}$ or not, and based on that judgment, if the count time $t_1$, is shorter than the upper limit set time $t_{max}$, the crushing duration time measuring unit 341 keeps such state, and if the count time $t_1$, is equal to or longer than the upper limit set time $t_{max}$ ($t_1 \geqq t_{max}$), the control process goes to the step S21 in which the timer is stopped and further proceeds to the step S2.

(4-2) Control of First Hydraulic Motor 1A of Crusher 1

Figure 10:
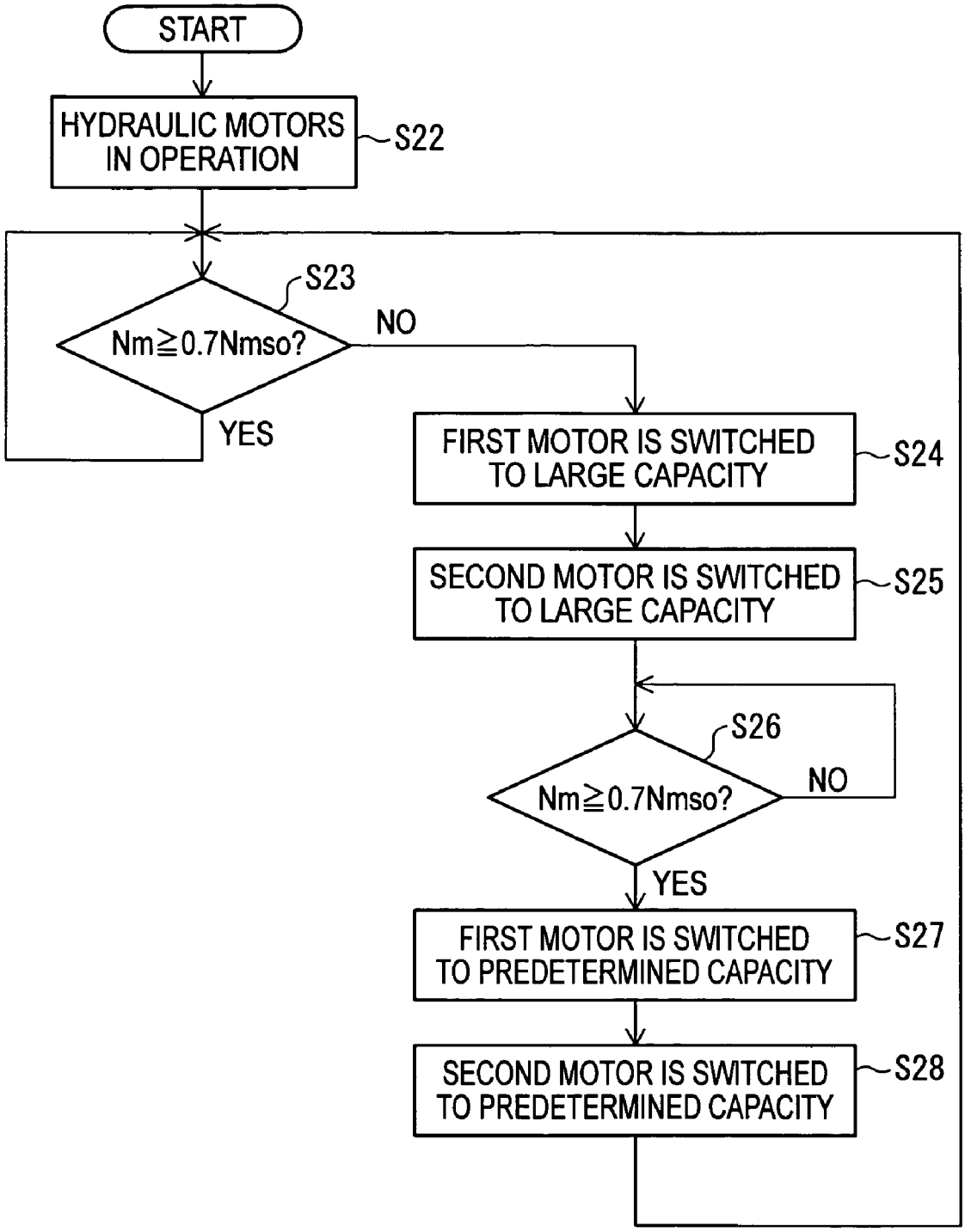
FIG. 10 is another flowchart showing crusher controlling operations according to the first embodiment.

Control of the first hydraulic motor 1A of the crusher 1 is performed based on the flowchart shown in FIG. 10.

(1) When the first hydraulic motor 1A and the second hydraulic motor 1B of the crusher 1 are operating with the predetermined capacity (step S22), the crusher rotation speed setting device 31 of the controller 30 outputs to the proportional solenoid valve 161C the current signal Im for supplying the hydraulic oil equivalent to the rotation speed Nmso. The first hydraulic motor 1A operates so as to rotate at the rotation speed in accordance with the supplied hydraulic oil, but actually, the first hydraulic motor 1A rotates under the load by crushing the wood, i.e. in a state where the rotation speed is slightly reduced as compared with an unloaded state.

(3) With increase in the load, the internal pressure in the pump line 161A also increases, but the current state will be kept until the actual rotation speed Nm of the crusher 1 becomes equal to or over 70% of the preset rotation speed Nmso (step S23).

(4) On the other hand, when the internal pressure in the pump line 161A increases to an internal pressure at which the actual rotation speed Nm becomes less than 70% of the preset rotation speed Nmso, the first hydraulic motor 1A switches the capacity automatically by the self-pressure from the predetermined capacity to the large capacity (step S24).

(5) The second hydraulic motor 1B is switched to the large capacity by the control signal from the controller 30 based on the hydraulic pressure detected by a pressure sensing unit (not shown in FIG. 6) provided in the piping line 161 (step S25).

(6) Subsequently, if the internal pressure in the pump line 161A does not decrease, the capacities of the first hydraulic pump 1A and the second hydraulic pump 1B are kept as-is, while if the internal pressure of the pump line 161A decreases to such a pressure at which the actual rotation speed Nm of the crusher 1 becomes equal to or over 70% of the preset rotation speed Nmso, the control process goes to the next step (step S26).

(7) In the next step S27, with decrease in the pressure in the pump line 161A, the first hydraulic motor 1A switches the capacity thereof to the predetermined capacity again (step S27).

(8) The second hydraulic motor 1B is switched to the predetermined capacity by the control signal from the controller 30 based on the hydraulic pressure detected by the pressure sensing unit (step S28).

[5] Effects of Embodiments (5-1) Effects and Advantages by Controlling Tub 2

In the above-described controls based on the flowcharts, the rotation speed Nm of the rotary crushing unit 1C is less than 70% of the preset rotation speed Nmso, and if the crusher 1 is in the overloaded state, the rotation of the tub 2 is stopped and the tub 2 is reversely rotated for the predetermined period of time (step S5 and step S6).

And except for starting time for operation, if the rotation speed Nm of the rotary crushing unit 1C is over 90% of the preset rotation speed Nmso and thereby the crusher 1 is in the underloaded state, the rotation of the tub 2 is restarted in order to restart the feeding of the object to be crushed (step S8).

And the crushing duration time $t_1$, from the restart of the rotation of the tub 2 to the next stop of the rotation of the tub 2 is counted (step S10).

If the count value $t_1$, is equal to or shorter than the set time $t_{10}$ ($t_1 \leqq t_{10}$), the command current Itm of the time when the rotation of the tub 2 is restarted next time is set to the command current value decreased by the constant current value Δ Ito from the command current Itm of the time when the rotation of the tub 2 was restarted this time (Itm=Itm−ΔIto) (step S5), thereby decreasing the rotation speed of the tub 2.

On the other hand, if the count value $t_1$, is longer than the set time $t_{10}$ ($t_1 > t_{10}$), the command current Itm of the time when the rotation of the tub 2 is restarted next time is set to the command current value increased by the constant current value Δ Ito from the command current Itm of the time when the rotation of the tub 2 was restarted this time (Itm=Itm+ΔIto) (step S18), thereby increasing the rotation speed of the tub 2.

Figure 11:
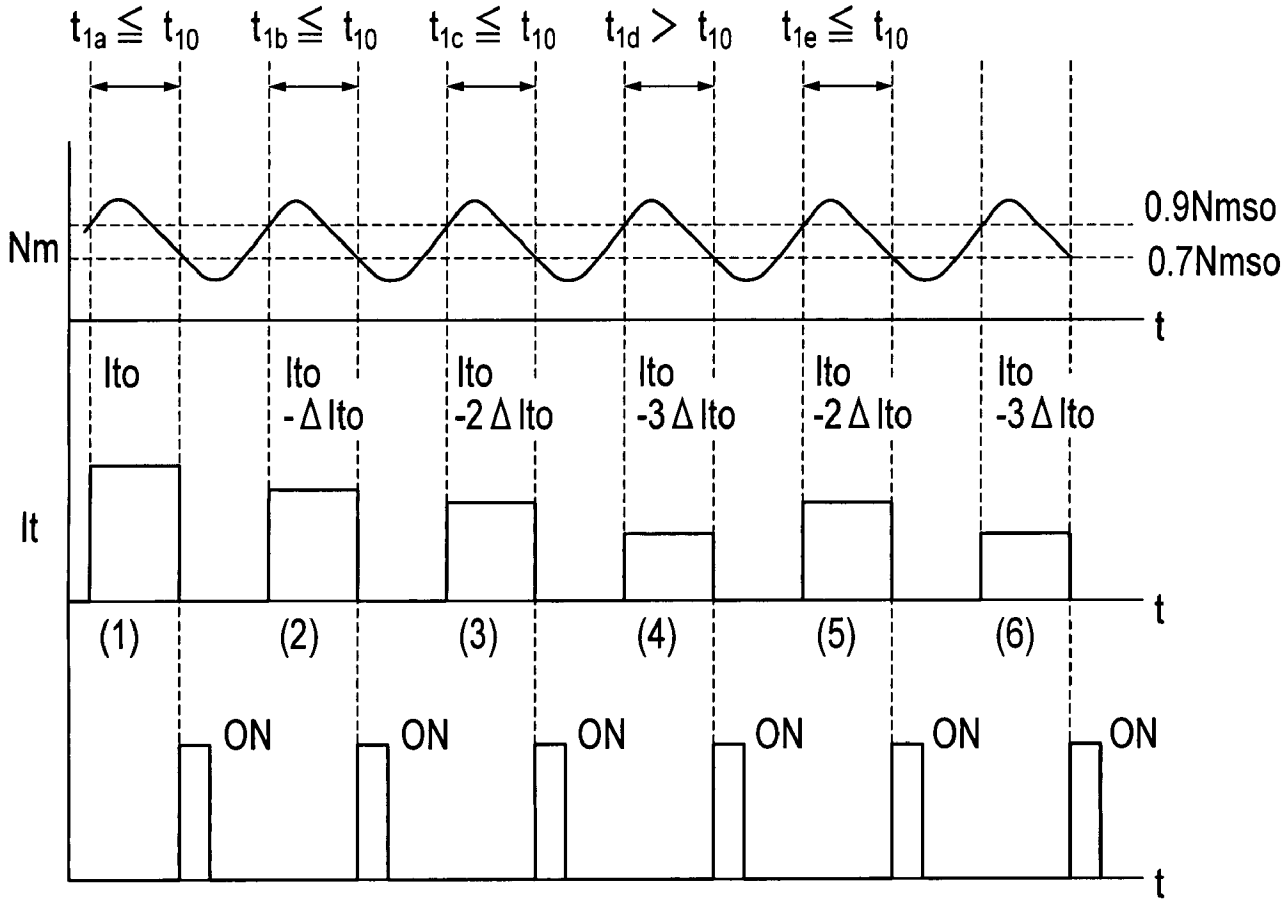
FIG. 11 is still another graph for explaining effects according to the first embodiment.

FIG. 11 shows concrete examples of controlling. In FIG. 11, in a first crushing (1), a second crushing (2) and a third crushing (3), since each crushing duration time $t_1$ is equal to or shorter than the set time $t_{10}$, the command current is decreased (It=Ito−ΔIto) in the second crushing (2), the command current is further decreased (It=Ito−2ΔIto) in the third crushing (3), and the command current is still further decreased (It=Ito−3A Ito) in a fourth crushing (4).

In the fourth crushing (4), since the crushing duration time $t_1$ is longer than the set time $t_{10}$, the command current is increased from the fourth time by Δ Ito (It=Ito−2ΔIto) in a fifth crushing (5).

And in the fifth crushing (5), since the crushing duration time $t_1$ is equal to or shorter than the set time $t_{10}$, the command current is decreased from the fifth time by Δ Ito (It=Ito−3ΔIto) in a sixth crushing (6)

Thus, in the crushing apparatus, when the crushing duration time $t_1$ is longer than the set time $t_{10}$, i.e. when the underloaded state continues long, the feeding of wood is somewhat insufficient, and by increasing the rotation speed of the tub of the next time than the rotation speed of the former time, the feeding amount of wood can be increased.

When the crushing duration time $t_1$, is shorter than the set time $t_{10}$, the feeding of wood is somewhat excessive, and by decreasing the rotation speed of the tub of the next time than the rotation speed of the former time, the feeding amount of wood can be decreased.

Accordingly, in the feeding of wood in the next time, the rotation speed of the tub 2 can be adjusted such that the feeding of wood is appropriate for crushing capacity of the crusher 1. In the crushing apparatus, operation of the crusher in the overloaded state can be avoided, thereby improving the operating efficiency, and the reduction in the load on the crusher can prevent the crusher 1 from being damaged.

Additionally, the rotation speed of the tub can be changed in accordance with the crushing duration time $t_1$, so that the feeding amount of wood to the crusher 1 can be optimized. Consequently, the operating time of the crusher 1 can be maximized to allow the effective crushing operation, thereby improving the total crushing amount (operating quantity). Furthermore, the load on the crusher 1 is recognized not instantly on the moment-to-moment basis but periodically on the duration time basis, thereby allowing more precise controlling.

In the crushing apparatus, since the loading state of the crusher 1 is sensed based on the rotation speed, the overloaded state of the crusher 1 can be easily sensed, the feeding amount of wood to the crusher 1 can be securely optimized.

In addition, the loading state of the crusher 1 can be known by detecting the hydraulic oil pressure supplied to the crusher, and same effects and advantages can be also obtained.

And the crushing duration time $t_1$ is sensed based on the rotation speed of the tub 2, the crushing duration time $t_1$, can be easily sensed, so that the feeding amount of the object to be crushed to the crusher can be securely optimized.

In the crushing apparatus, the command upper limit value Ito and the command lower limit value Itmin are set for the command current Itm when the rotation of the tub 2 is restarted, the upper limit value and the lower limit value are set for the tub rotation speed, and the lower limit value is the rotation marginal value at which the rotation of the tub is not stopped. Thus, the rotation speed of the tub 2 does not exceed the upper limit value, so that it can be prevented that the wood is excessively fed to the crusher 1 beyond the preset value, thereby securing the safety.

The lower limit value of the rotation speed of the tub is set to the rotation marginal value at which the rotation of the tub is not stopped, so that the tub 2 will be surely rotated even at a low speed. Hence, even if the tub rotation speed is decreased by the control by the apparatus, the crusher can be fed with the wood to perform the crushing operation, thereby preventing reduction in the operating quantity.

On the other hand, in an apparatus in which the rotation of the tub 2 is stopped, an operator cannot distinguish whether the apparatus is stopped (crushing operation is stopped) or the tub is stopped due to overloading, countermeasures taken in such a circumstance may not be appropriate, reducing the workability.

In the crushing apparatus, if the crushing duration time $t_1$ exceeds the upper limit set time $t_{max}$ which is longer than the set time $t_{10}$, the command current It to the proportional solenoid valve 167C of the tub 2 is set to the command upper limit value Ito and the rotation speed of the tub is set to the upper limit value.

Specifically, the rotation speed of the tub 2 is set to the upper limit value in order to optimize the feeding amount of the object to be crushed to the crusher 1 and to reduce the load on the tub motor 2A, since the feeding amount of the object to be crushed to the crusher is somewhat in sufficient when the underloaded state continues long.

(5-2) Effects and Advantages by Controlling Hydraulic Motor for Changing Capacity In FIG. 6, the rotary crushing unit 1C is driven by the pair of the hydraulic motors 1A and 1B for driving which are connected to each end thereof.

The first hydraulic motor 1A is a capacity-variable motor that can switch the capacity thereof by the self-pressure between a predetermined capacity and a large capacity greater than the predetermined capacity.

The second hydraulic motor 1B is a capacity-switchable motor that switches between large and small of an inclination angle in order to switch between a predetermined capacity and a large capacity greater than the predetermined capacity. Incidentally, the large capacity means that the amount of hydraulic oil required for one rotation of the hydraulic motor 1A or 1B is larger than the predetermined capacity.

In the flowchart of FIG. 10, if the crusher 1 is in the overloaded state in the step S23, the first hydraulic motor 1A and the second hydraulic motor 1B are switched from the predetermined capacity of a normal crushing state to the large capacity in steps S24 and S25, respectively.

Specifically, when the crusher 1 is in the overloaded state and the feeding of wood thereto from the tub 2 is halted, the first hydraulic motor 1A and the second hydraulic motor 1B are switched from the predetermined capacity of the normal crushing state to the large capacity. In the overloaded state, the pump line 161A is relieved by the relief valve 161F, and the first hydraulic motor 1A is switched to the large capacity automatically by the relief pressure (or a pressure a bit lower than the relief pressure). The second hydraulic motor 1B is switched to the large capacity and returned therefrom by the pressure sensed by the pressure sensing unit (not shown).

If the first hydraulic motor 1A and the second hydraulic motor 1B are switched to the large capacity, the output torque is increased.

Generally, the generated torque of the hydraulic motor is proportional to the motor capacity (piston displacement) and to the driving pressure of the motor.

On the other hand, the torque required for accelerating or decelerating a rotating body with rotary inertia is proportional to roll acceleration (angular acceleration) and moment of inertia.

Accordingly, if the generated torques of the hydraulic motors 1A and 1B affects the acceleration of the rotating body, the causes and effects are: an increase in the motor capacity causes an increase in the output torque of the motor, which causes an increase in the roll acceleration, which then causes a reduction in time required to increase the predetermined rotation speed.

As described above, in the standby state due to overloading until the feeding of the object to be crushed to the rotary crusher is started, the time required for the crusher 1 to be recovered to the predetermined rotation speed can be shortened.

Figure 12:
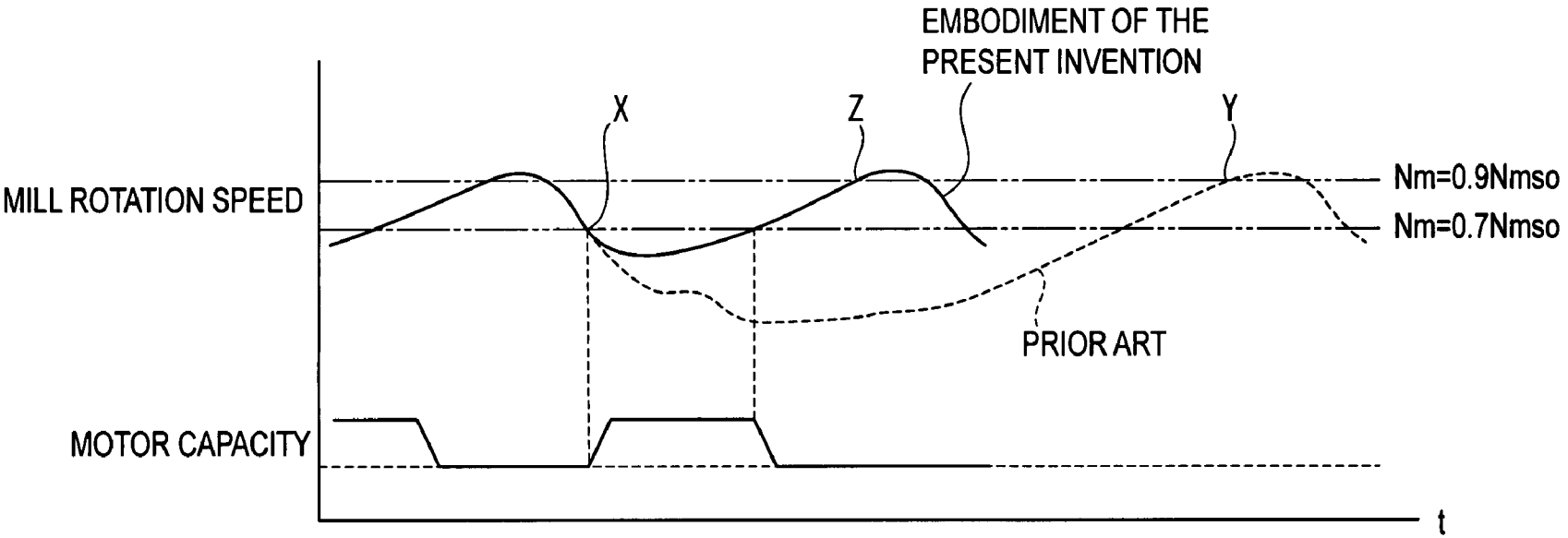
FIG. 12 is further another graph for explaining advantages according to the first embodiment.

FIG. 12 shows how the rotation speeds of the above-described embodiment of the present invention and a prior art change. In FIG. 12, the above-described embodiment is indicated in a full line, while the prior art is indicated in a dashed line.

After the rotation speed Nm of the rotary crushing unit 1C becomes less than 70% of the preset rotation speed Nmso, i.e. the crusher 1 has entered the overloaded state, so that the crusher 1 is placed in the standby state in which the rotation of the tub 2 is stopped (point X in the figure), the rotation of the tub 2 is restarted at point Y in the prior art and at point Z in the embodiment, i.e. at the time points when the rotation speed Nm of the rotary crushing unit 1C reaches 90% of the preset rotation speed Nmso and the crusher 1 is in the underloaded state. Concretely, the time required for the crusher 1 to recover to the predetermined rotation speed is approximately twenty seconds in the prior art, but approximately eight seconds in the embodiment, which is considerably shorter.

Thus, according to the crushing apparatus, in the standby state due to overloading until the feeding of the object to be crushed to the rotary crusher is started, the time required for the crusher 1 to be recovered to the predetermined rotation speed can be shortened.

Consequently, the operating efficiency can be improved and the operating quantity can be increased.

The relief amount of the relief valve 161F in the overloaded state can be reduced by switching the first hydraulic motor 1A and the second hydraulic motor 1B to the large capacity.

Accordingly, a part of the hydraulic pressure that has been relieved when the feeding of the object to be crushed to the crusher 1 is stopped can be utilized, thereby decreasing a loss in the hydraulic pressure and realizing energy saving.

In the crushing apparatus, the first hydraulic motor 1A and the second hydraulic motor 1B are returned to the predetermined capacity, when the hydraulic motors 1A and 1B get out of the overloaded state.

Specifically, in the flowchart of FIG. 10, if the rotation speed Nm of the rotary crushing unit 1C is recovered to 70% of the preset rotation speed Nmso or more in the step S26, the control process goes to the step S27 and the first hydraulic motor 1A and the second hydraulic motor 1B are returned to the predetermined capacity.

The hydraulic motors 1A and 1B can be returned to the former predetermined capacity, because the torques do not need to be increased when the hydraulic motors 1A and 1B are out of the overloaded state, and therefore, unnecessary operation can be avoided and fuel consumption can be reduced. Incidentally, the timing to return to the predetermined capacity may be the time point at which the rotation speed of the rotary crushing unit 1C has recovered to 90% of the preset rotation speed Nmso or more.

(5-3) Other Effects and Advantages

The crushing apparatus includes not only one hydraulic motor, but two i.e. the first hydraulic motor 1A and the second hydraulic motor 1B.

Hence, each motor 1A or 1B can be downsized, thereby realizing compactification as a whole and easy layout of the crusher, the motor or the like can be achieved.

Additionally, in the crushing apparatus, both of the first hydraulic motor 1A and the second hydraulic motor 1B are capacity-variable motors that can switch the capacity between the large capacity and the predetermined capacity.

For instance, by switching both capacities of the first hydraulic motor 1A and the second hydraulic motor 1B to the large capacity, the output torque can be increased, while by switching both capacities of the first hydraulic motor 1A and the second hydraulic motor 1B to the predetermined capacity, the output torque can be decreased Therefore, by switching both of the hydraulic motors 1A and 1B to the large capacity on a starting or the like, a quick starting can be realized. Further, even if the second hydraulic motor 1B is switched to the large capacity with the purpose of high torque crushing or the like, or switched to the predetermined capacity, the first hydraulic motor 1A can be controlled to be at the large capacity in the standby state due to overloading before the feeding of the object to be crushed to the rotary crusher is started, so that the output torque is increased, and the rotation speed of the rotary crusher 1 can be recovered quickly.

In the crushing apparatus, since the first hydraulic motor 1A is the control motor in which the capacity is changed by the self-pressure, the hydraulic motor 1A can be automatically switched to the large capacity in the standby state due to overloading before the feeding of the object to be crushed to the rotary crusher 1 is started.

Thus, the time before the rotation speed of the crusher is recovered to a predetermined rotation speed can be automatically and securely shortened, thereby improving reliability in increasing the operating quantity.

Second Embodiment

A second embodiment of the present invention will be described below. Incidentally, explanations about the components identical with the components which have been described above will be omitted or simplified below.

In the above-mentioned crushing apparatus according to the first embodiment, the first hydraulic motor 1A is a capacity-variable motor in which the capacity thereof can be changed only by the self-pressure.

Figure 13:
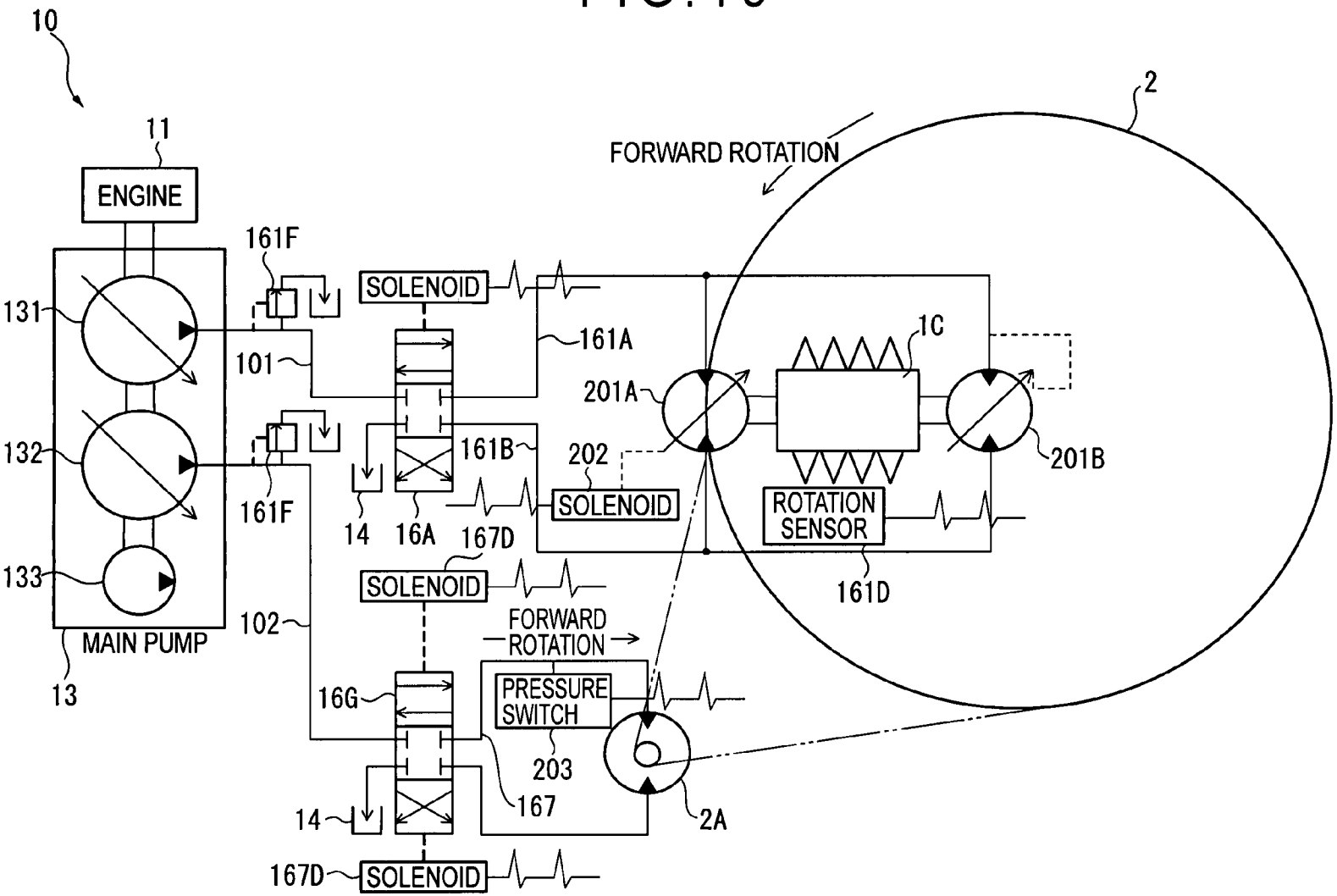
FIG. 13 is a schematic illustration showing a primary portion of a crushing apparatus according to a second embodiment of the present invention.

In contrast, in the crushing apparatus according to the second embodiment, as shown in FIG. 13, a solenoid 202 is connected to the first hydraulic motor 201A for setting changes in the capacity of the first hydraulic motor 201A.

If the operator switches a capacity setting switch of the first hydraulic motor 201A on the operation panel to on, the first hydraulic motor 201A is set to a small capacity by the solenoid 202, and if the capacity setting switch is off, the first hydraulic motor 201A is set to the large capacity. Incidentally, such capacity switching in accordance with the load on the first hydraulic motor 201A is performed similarly to the first embodiment of the present invention.

In the first embodiment, the second hydraulic motor 1B is switched between the predetermined capacity and the large capacity by the control signal output by the controller 30 based on the hydraulic pressure detected by the pressure sensing unit (not shown).

Figure 14:
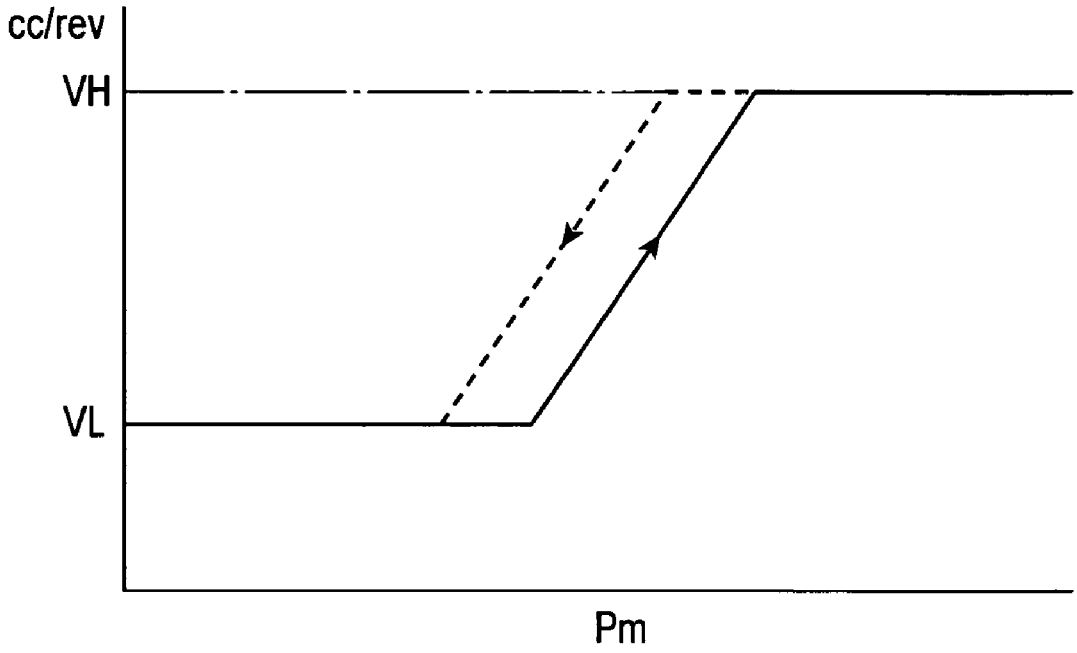
FIG. 14 is a graph showing a relation between a pressure and capacity of a second hydraulic motor according to the second embodiment.

In the crushing apparatus according to the second embodiment, the second hydraulic motor 201B is different in a point that the capacity is changed by the self-pressure. Specifically, as shown in FIG. 14, the second hydraulic motor 201B is switched to the large capacity VH (upper portion in the right of FIG. 14) when the pressure in the pump line 161A becomes equal to or over a predetermined certain value, while the second hydraulic motor 201B is switched to the predetermined capacity VL (lower portion in the left of FIG. 14) when the pressure in the pump line 161A becomes less than the predetermined certain value.

In addition, in the crushing apparatus according to the second embodiment, the pressure switch 203, which is provided in the first embodiment (however, not shown), is also provided in the piping line 167 of the tub motor 2A, but the pressure switch 203 works, when the crusher is judged to be in the overloaded state, as a trigger sensor for exciting the solenoid 167D for stopping or reversely rotating the tub 2.

Although the crushing apparatus according to the second embodiment differs from the crushing apparatus of the first embodiment in the point as described above, the control structure of the tub motor 2A and control flow thereof and the control structure of the first hydraulic motor 201A and control flow thereof are substantially same as the first embodiment, so that the description will be omitted.

Also in such crushing apparatus according to the second embodiment, the same effects and advantages as described in the first embodiment can be enjoyed.

Third Embodiment

A third embodiment of the present invention will be described below.

In the above-described crushing apparatus according to the second embodiment, the solenoid 202 disposed to the first hydraulic motor 201A is provided such that the operator can set the capacity of the first hydraulic motor 201A.

Figure 15:
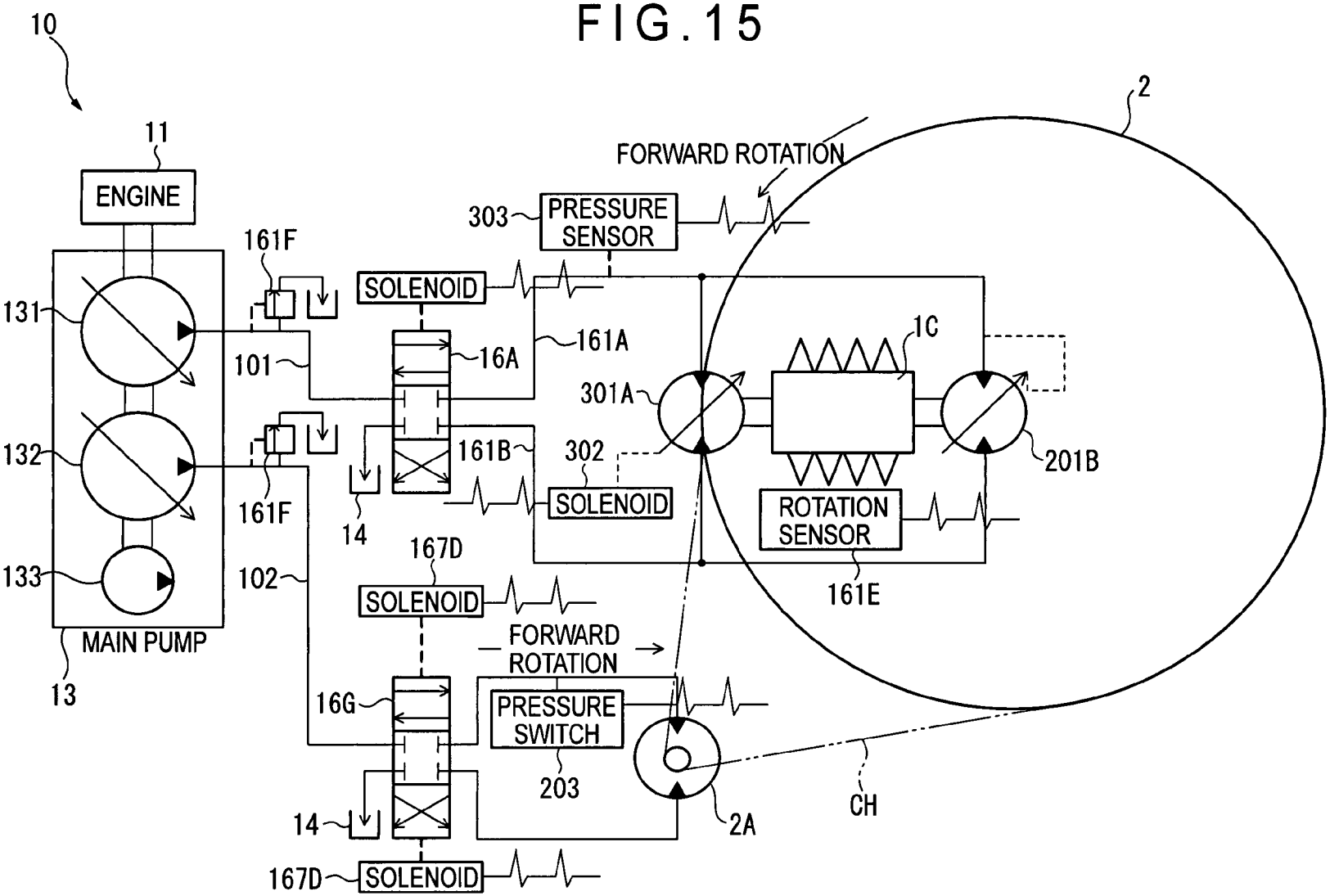
FIG. 15 is a schematic illustration showing a primary portion of a crushing apparatus according to a third embodiment of the present invention.

The crushing apparatus according to the third embodiment differs in a point that a motor of which capacity is switched by the self-pressure is not employed as the first hydraulic motor 301A but a motor of which capacity is switched by exciting the attached solenoid 302 is employed, as shown in FIG. 15.

In the third embodiment, as a trigger sensor for switching the capacity of the first hydraulic motor 301A by the solenoid 302, the pressure sensor 303 is provided in the pump line 161A, and by processing the output of the pressure sensor 303 by the controller 30, the solenoid 302 is excited.

Figure 16:
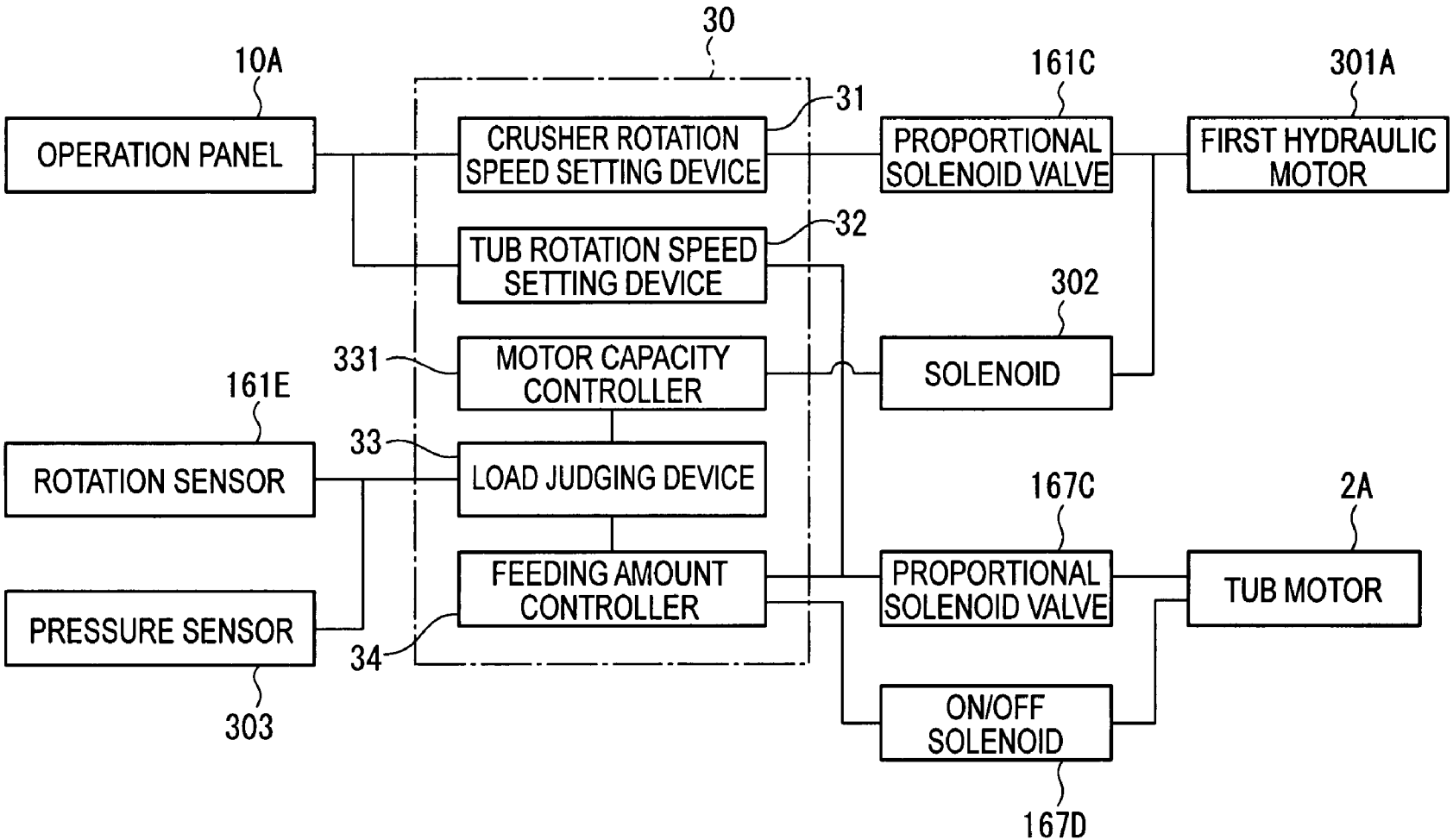
FIG. 16 is a functional block diagram showing a structure of a controller according to the third embodiment.

The control structure of the controller 30 is shown in the functional block diagram of FIG. 16, and the controller 30 further includes a motor capacity controller 331 run as software by the processing unit of the controller 30 in addition to the crusher rotation speed setting device 31, the tub rotation speed setting device 32, the load judging device 33, and the feeding amount controller 34 that are same as the first embodiment.

The load judging device 33 judges the overloaded state in accordance with not only a signal from the rotation sensor 161E but also with a signal output from the pressure sensor 303 like in the first embodiment. Based on the signal from the pressure sensor, the load judging device 33 judges as the overloaded state when the detected pressure is higher than a predetermined threshold value, while as the underloaded state when the detected pressure is equal to or lower than the predetermined threshold value.

The motor capacity controller 331 outputs a control signal to the solenoid 302 based on the judgment result of the load judging device 33, and when the solenoid 302 is excited, the capacity of the first hydraulic motor 301A is changed to the large capacity.

Figure 17:
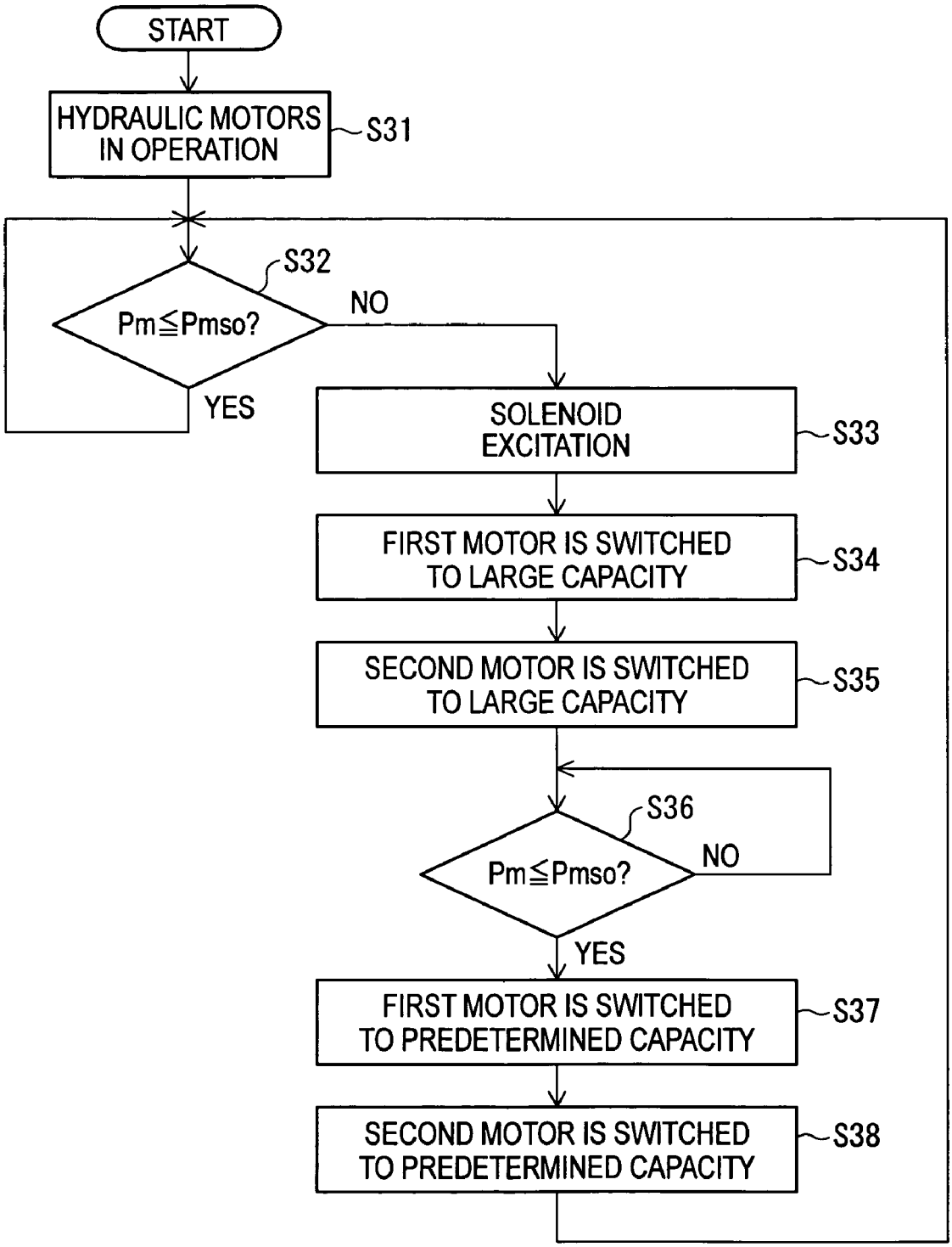
FIG. 17 is a flowchart showing crusher controlling operations according to the third embodiment.
Figure 18:
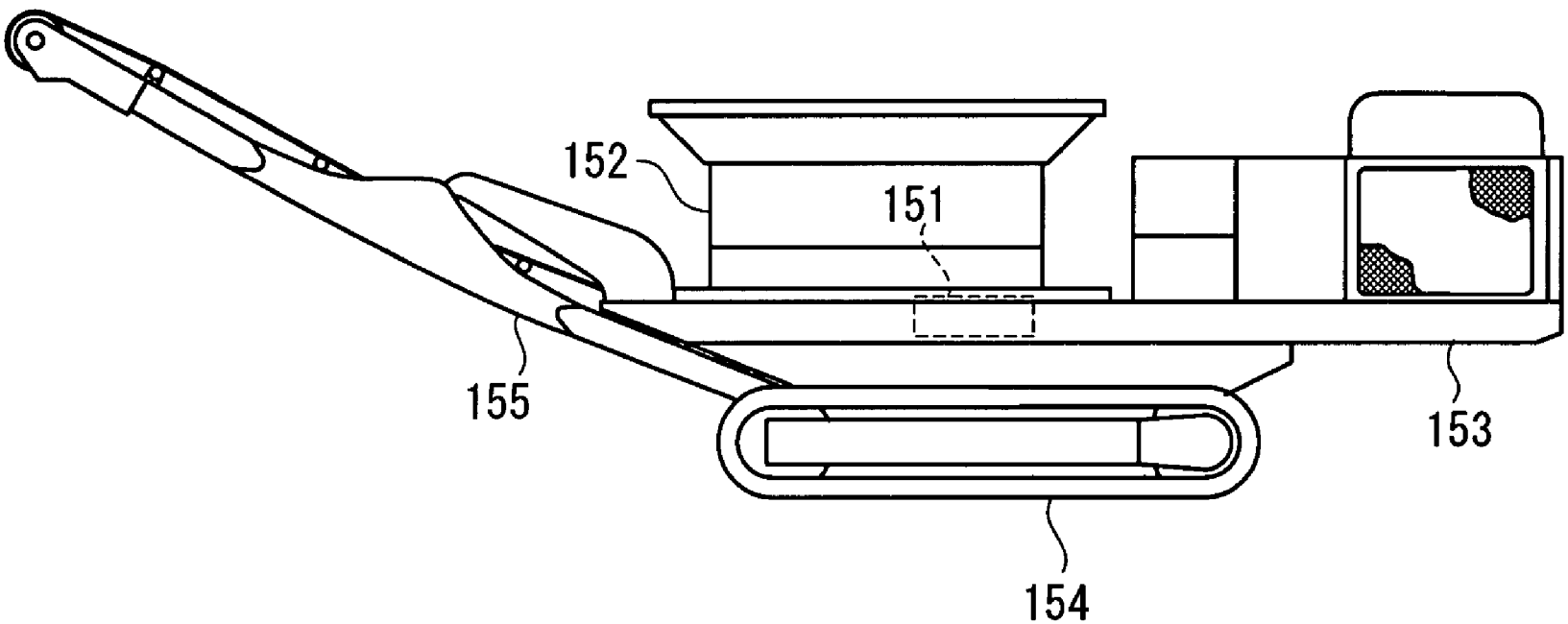
FIG. 18 is a side view showing a conventional crushing apparatus.

Switching control by the controller 30 of the first hydraulic motor 301A and the second hydraulic motor 201B is performed based on the flowchart shown in FIG. 17.

(1) When the first hydraulic motor 301A and the second hydraulic motor 201B of the crusher are operating with the predetermined capacity (step S31), the load judging device 33 of the controller 30 monitors the pressure Pm of the pump line 161A based on the current signal from the pressure sensor.

(2) The load judging device 33 compares the pressure Pm of the pump line 161A with a preset threshold value Pmso (step S32), and when the detected pressure Pm is judged to be equal to or lower than the threshold value Pmso, the load judging device 33 keeps the state.

(3) When the detected pressure Pm is judged to be higher than the threshold value Pmso, the load judging device 33 outputs a message signal to the motor capacity controller 331. The motor capacity controller 331 generates a signal for exciting the solenoid 302 in order to excite the solenoid 302, and turns on a switch of the capacity of the first hydraulic motor 301A (step S33).

(4) The capacity of the first hydraulic motor 301A is changed to the large capacity due to the excitation of the solenoid 302. The second hydraulic motor 201B, of which capacity is changed by the self-pressure, is automatically switched to the large capacity, when the pressure in the pump line 161A becomes equivalent to the threshold value Pmso (step S35).

(5) The load judging device 33 also monitors the pressure Pm detected by the pressure sensor 303 to compare with the threshold value Pmso (step S36), and when the detected pressure Pm is judged to be higher than the threshold value Pmso, the load judging device 33 keeps the state.

(6) When the detected pressure Pm is judged to be equal to or lower than the threshold value Pmso, the excitation of the solenoid 302 is stopped, so that the solenoid 302 is returned to the original state by a reaction force of a spring or the like, thereby the switch of the capacity of the first hydraulic motor 301A is switched to the predetermined capacity (step S37).

(7) As the pressure in the pump line 161A is decreased, the self-pressure of the second hydraulic motor 201B is also decreased, thereby the capacity of the second hydraulic motor 201B is automatically switched to the predetermined capacity.

Incidentally, since controlling by the rotation speed of the rotary crushing unit 1C of the tub 2 is same as the first embodiment, the description is omitted.

In the crushing apparatus according to the third embodiment, the following advantages can be enjoyed in addition to the same effects and advantages as the first embodiment.

Specifically, unlike the first embodiment, the feeding by the tub 2 and the crushing by the crusher are controlled based on completely different parameters (rotation speed, pump line pressure), so that the feeding and the crushing can be independently controlled, improving the flexibility in controlling.

Controlling by pressure can also be used to control the switching of the capacity of the transport conveyor. Specifically, when a carrying amount of the transport conveyor is increased, a large load is placed on the driving motor for driving the conveyor and the pressure in the piping line to the conveyor driving motor is increased. Thus, if the functional block diagram shown in FIG. 16 is used as-is for a control system of the transport conveyor, switching of the capacity can be performed, indicating very high versatility thereof.

[Modifications]

In the first embodiment of the present invention, the crusher 1 is arranged to stop the rotation of the tub 2 when the crusher 1 is in the overloaded state and to start the rotation of the tub 2 when the crusher 1 is in the underloaded state, but the crusher 1 may be arranged to decrease the rotation of the tub 2 when the crusher 1 is in the overloaded state and to increase the rotation of the tub 2 when the crusher 1 is in the underloaded state Additionally, in the first embodiment, the crusher 1 having the rotary crushing unit 1C and the wood-crushing apparatus having the rotary tub 2 are exemplified, but the object to be crushed is not limited to wood but may be rocks or the like, a feeding unit for feeding the object to be crushed is not limited to the rotary tub 2 but may be a belt conveyor or the like, and the crusher 1 is not limited to a crusher having the rotary crushing unit 1C but may be a crusher having a jaw crusher or the like.

INDUSTRIAL APPLICABILITY

The present invention can be preferably used for a crushing apparatus for crushing an object to be crushed such as wood and rocks, especially for a wood-crushing apparatus.

The invention claimed is:

1. A crushing apparatus comprising:

a rotary crusher;

a hydraulic motor for rotating the rotary crusher, wherein the hydraulic motor is a capacity variable motor that can be switched between a predetermined capacity and a large capacity;

a feeder for feeding an object to be crushed to the rotary crusher;

a controller for controlling the feeder and the hydraulic motor;

a load detector for detecting a loading state of the hydraulic motor;

a load judging device for judging whether the loading state of the hydraulic motor detected by the load detector is in an overloaded state or an underloaded state;

a feeding amount controller for decreasing or stopping a feeding by the feeder of the object to be crushed when the load judging device judges that the hydraulic motor is in the overloaded state and for increasing or starting the feeding by the feeder of the object to be crushed when the load judging device judges that the hydraulic motor is in the underloaded state; and a motor capacity controller for changing a capacity of the capacity-variable motor to the large capacity when the load judging device judges that the hydraulic motor is in the overloaded state;

wherein the feeding amount controller includes:

a crushing duration time measuring unit for measuring a crushing duration time between time points when the feeding of the object to be crushed is increased or started and when the feeding of the object to be crushed is decreased or stopped;

a time judging unit for judging whether the measured crushing duration time is longer than a predefined set time; and a feeding amount adjusting unit that decreases a capability of the feeder in a subsequent feeding process when the measured crushing duration time is equal to or shorter than the set time, and increases the capability of the feeder in the subsequent feeding process when the measured crushing duration time is longer than the set time.

2. The crushing apparatus according to claim 1, wherein the motor capacity controller returns the capacity of the hydraulic motor to the predetermined capacity when the load judging device judges that the hydraulic motor is out of the overloaded state.

3. The crushing apparatus according to claim 1, wherein the rotary crusher is driven by two hydraulic motors; and one of the hydraulic motors is the capacity-variable motor.

4. The crushing apparatus according to claim 3, wherein the other of the hydraulic motors is a capacity-switchable motor that can be switched between two positions respectively providing the large capacity and the predetermined capacity.

5. The crushing apparatus according to claim 1, wherein the capacity-variable motor is a control motor that changes the capacity by self-pressure.

6. The crushing apparatus according to claim 1, wherein the feeder is a tub that is rotatably provided on an upper portion of the crusher, the tub rotating to feed the object to be crushed to the crusher; and the crushing duration time measuring unit measures a forward-rotation time of the tub which rotates in a direction for feeding the object to be crushed to the crusher to provide as the crushing duration time.

7. The crushing apparatus according to claim 6, wherein an upper limit value and a lower limit value of the forward-rotation speed are set for the tub; and the feeding amount controller has a lower limit value setting unit for setting the lower limit value as a rotation marginal value at which the rotation of the tub is not stopped.

8. The crushing apparatus according to claim 7, wherein the feeding amount controller has an upper limit value setting unit for setting the preset rotation speed for the tub to the upper limit value of the rotation speed when the measured crushing duration time is judged to be longer than the set time.

* * * * *